US012054908B2

(12) United States Patent
Masuda

(10) Patent No.: US 12,054,908 B2
(45) Date of Patent: Aug. 6, 2024

(54) WORKING MACHINE

(71) Applicant: KUBOTA CORPORATION, Osaka (JP)

(72) Inventor: Ryohei Masuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 926 days.

(21) Appl. No.: 17/102,856

(22) Filed: Nov. 24, 2020

(65) Prior Publication Data

US 2021/0079619 A1 Mar. 18, 2021

Related U.S. Application Data

(63) Continuation of application No. PCT/JP2019/021385, filed on May 29, 2019.

(30) Foreign Application Priority Data

Jun. 5, 2018 (JP) ..... 2018-107761
Jun. 5, 2018 (JP) ..... 2018-107762

(51) Int. Cl.

| | |
|---|---|
| ***E02F 3/38*** | (2006.01) |
| ***E02F 3/32*** | (2006.01) |
| ***E02F 9/00*** | (2006.01) |
| ***E02F 9/12*** | (2006.01) |

(52) U.S. Cl.

CPC ..... *E02F 3/384* (2013.01); *E02F 3/325* (2013.01); *E02F 9/006* (2013.01); *E02F 9/121* (2013.01)

(58) Field of Classification Search

CPC .. E02F 9/006; E02F 9/0858; Y10T 403/32861
USPC ..... 403/154
See application file for complete search history.

(56) References Cited

U.S. PATENT DOCUMENTS 2,967,726 A * 1/1961 Weston ..... E02F 9/006 403/157
2005/0241196 A1 11/2005 Martinez
2008/0089627 A1* 4/2008 Yamamoto ..... F16C 23/045 384/473
2013/0017048 A1* 1/2013 Kimura ..... B60H 1/00564 414/687

FOREIGN PATENT DOCUMENTS

EP 2662500 A1 11/2013
JP 51-77462 U 6/1976

(Continued)

*Primary Examiner* — Ronald P Jarrett
(74) *Attorney, Agent, or Firm* — Birch, Stewart, Kolasch & Birch, LLP

(57) ABSTRACT

A working machine according to one aspect of the present invention, includes a support member, a turn member, a pin inserted to both of the support member and the turn member to turnably support the turn member on the support member, a flange fixed to the pin, a collar inserted to an insertion hole formed in the flange, a retainer bolt inserted to the collar and attached by being screwed to the turn member and the support member, a contact portion included in the flange, and a regulator included in the support member. The regulator contacts to the contact portion with a clearance kept between the collar and an inner circumference surface of the insertion hole, thereby regulating turning of the flange around the pin.

5 Claims, 31 Drawing Sheets

(56) References Cited

FOREIGN PATENT DOCUMENTS

| | | | |
|---|---|---|---|
| JP | 53-153301 | U | 12/1978 |
| JP | 58-6860 | U | 1/1983 |
| JP | 60-128013 | U | 8/1985 |
| JP | 6-300033 | A | 10/1994 |
| JP | 8-49255 | A | 2/1996 |
| JP | 11-343635 | A | 12/1999 |
| JP | 2000-170208 | A | 6/2000 |
| JP | 2000-220791 | A | 8/2000 |
| JP | 2001-207476 | A | 8/2001 |
| JP | 2004-3592 | A | 1/2004 |
| JP | 2004-68958 | A | 3/2004 |
| JP | 2004-150118 | A | 5/2004 |
| JP | 2004-353398 | A | 12/2004 |
| JP | 2005-83040 | A | 3/2005 |
| JP | 2005-232712 | A | 9/2005 |
| JP | 2007-92283 | A | 4/2007 |
| JP | 2008-95298 | A | 4/2008 |
| JP | 2009-36324 | A | 2/2009 |
| JP | 2013-104437 | A | 5/2013 |
| JP | 2016-142101 | A | 8/2016 |
| JP | 2017-66791 | A | 4/2017 |

* cited by examiner

WORKING MACHINE

CROSS-REFERENCE TO RELATED APPLICATIONS

The present application is a continuation application of International Application No. PCT/JP2019/021385, filed May 29, 2019, which claims priority to Japanese Patent Application No. 2018/107761, filed Jun. 5, 2018 and to Japanese Patent Application No. 2018/107762, filed Jun. 5, 2018. The contents of these applications are incorporated herein by reference in their entirety.

BACKGROUND OF THE INVENTION

Field of the Invention

The present invention relates to a working machine such as a backhoe.

Description of Related Art

The working machine disclosed in Japanese Unexamined Patent Publication No. 2005-232712 and Japanese Unexamined Patent Publication No. 2017-66791 is known.

Japanese Unexamined Patent Publication No. 2005-232712 describes the working machine including a structure for retaining a pin inserted across a base end portion of a boom (turn member) and a swing bracket (support member) as a structure for retaining a pin that pivots the turn member on a support member. In this structure, the pin is retained by being screwed to fix a flange to the pin and attaching a retainer bolt, which is inserted through a insertion hole formed in the flange, to a base end portion of the boom.

The working machine disclosed in Japanese Unexamined Patent Publication No. 2017-66791 has a swivel frame supported on the traveling device by means of a swivel bearing and capable of swiveling around a longitudinal axis. A swivel motor is mounted on the swivel frame, and a swivel pinion is attached to the swivel motor. The swivel pinion is engaged with an inner tooth gear provided on an inner side of the swivel bearing. By driving the swivel pinion by the swivel motor, the swivel pinion moves while engaging with the inner tooth gear, which causes the swivel frame to swivel. A swivel joint is disposed at the longitudinal axis center position.

SUMMARY OF THE INVENTION

A working machine according to one aspect of the present invention, includes: a support member; a turn member; a pin inserted to both of the support member and the turn member to turnably support the turn member on the support member; a flange fixed to the pin; a collar inserted to an insertion hole formed in the flange; a retainer bolt inserted to the collar and attached by being screwed to the turn member and the support member; a contact portion included in the flange; and a regulator included in the support member. The regulator contacts to the contact portion with a clearance kept between the collar and an inner circumference surface of the insertion hole, thereby regulating turning of the flange around the pin.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
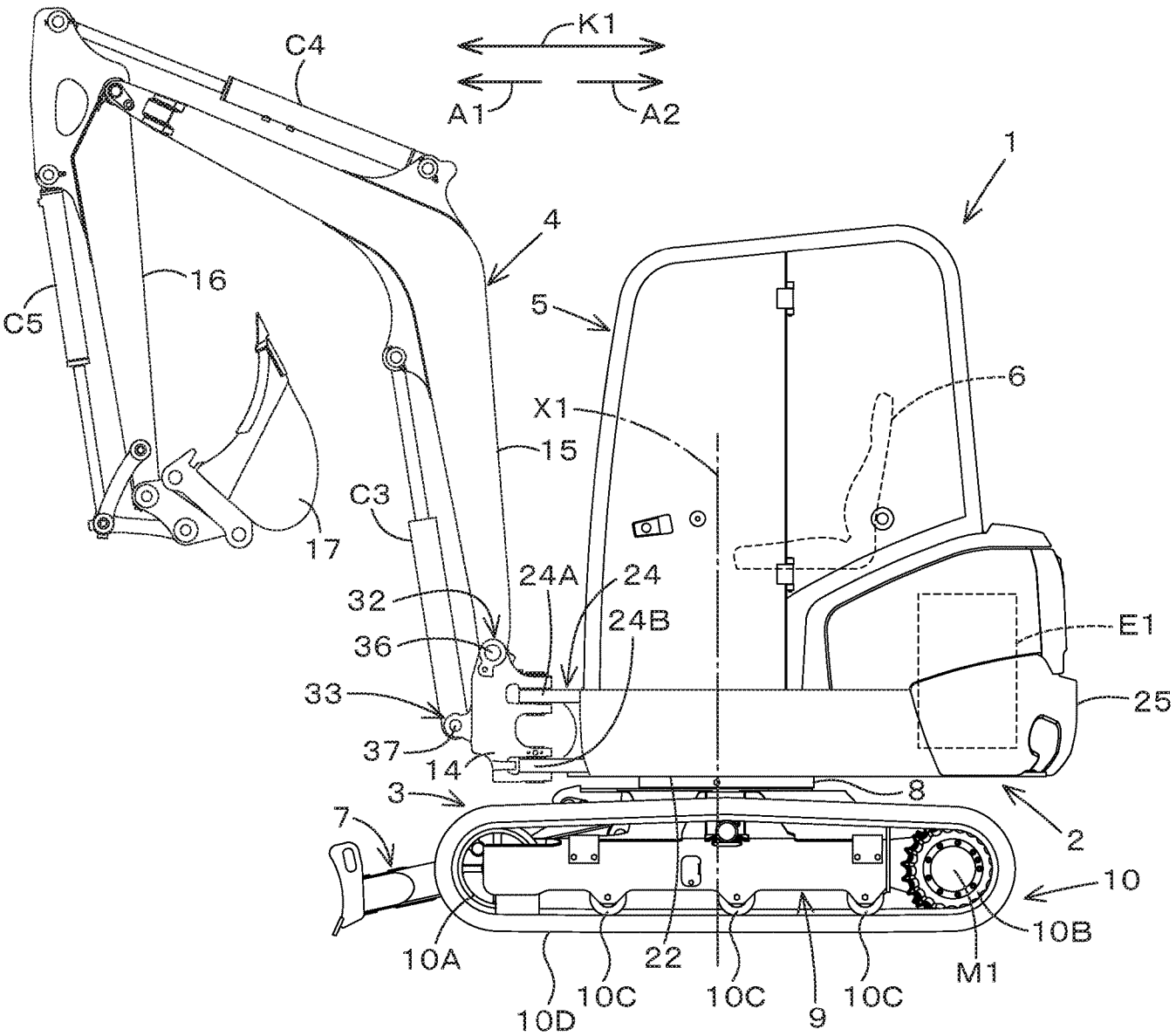
FIG. 1 is a side view of a working machine.

The embodiments of the present invention will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with appropriate reference to the drawings.

First, the overall configuration of the working machine 1 will be briefly described.

FIG. 1 is a schematic side view showing the overall configuration of the working machine 1 in the present embodiment. In this embodiment, a backhoe, which is a swivel working machine, is illustrated as the working machine 1.

As shown in FIG. 1, the working machine 1 is provided with an machine body (swivel base) 2, a traveling device 3, and a working device 4. A cabin 5 is mounted on the machine body 2. An operation seat 6 is provided in the interior of the cabin 5. A canopy may be mounted in place of the cabin.

In this embodiment, the front side of the operator seated on the operation seat 6 of the working machine 1 (an arrowed line A1 in FIG. 1) is described as the front, the rear side of the operator (an arrowed line A2 in FIG. 1) is described as the rear, the left side of the operator (a front surface side of FIG. 1) is described as the left, and the right side of the operator (a back surface side of FIG. 1) is described as the right.

Figure 2:
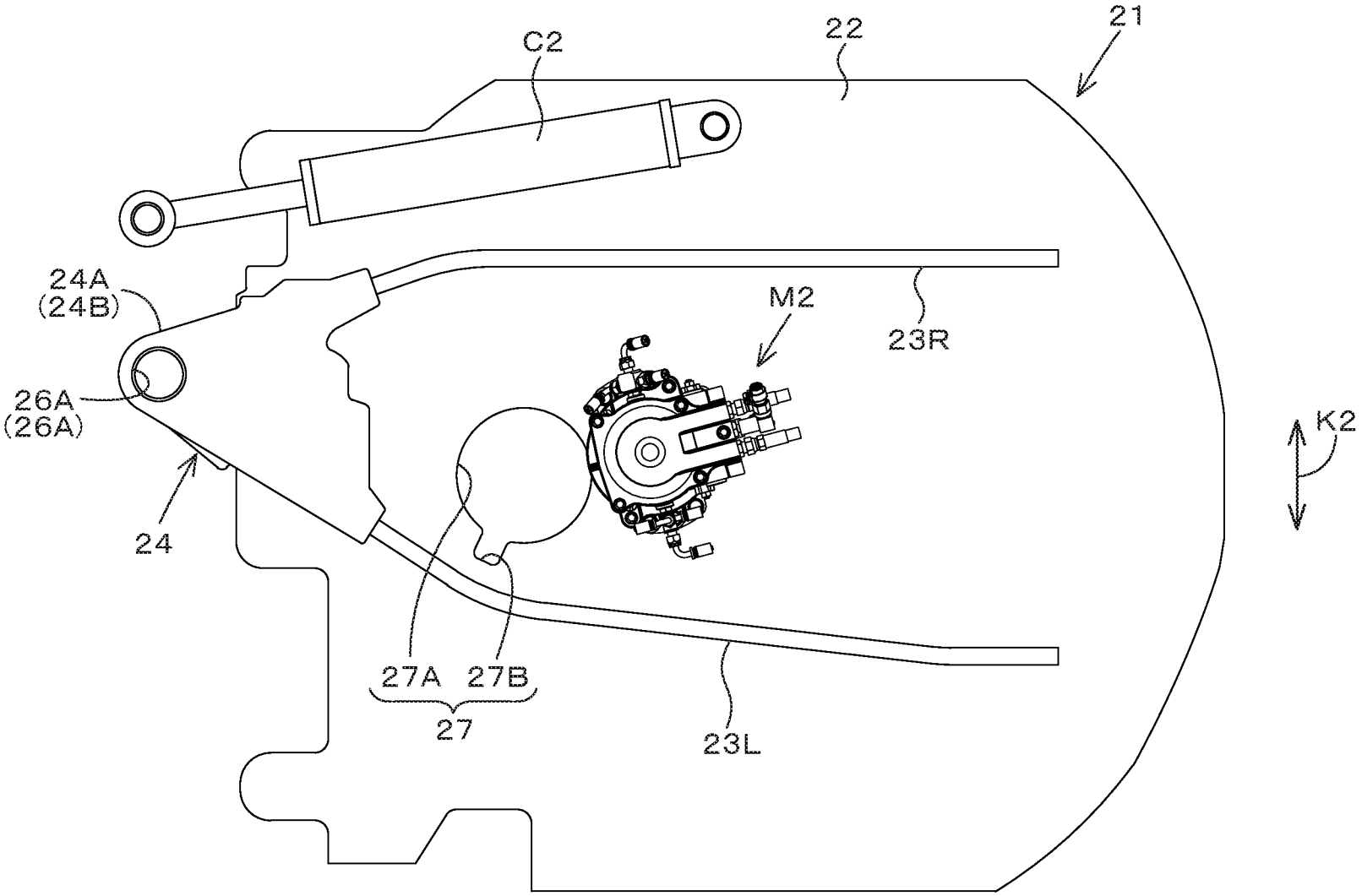
FIG. 2 is a plan view of a turn frame.

The horizontal direction, which is the direction perpendicular to a front-back direction K1, is explained as the machine width direction K2 (see FIG. 2). The direction from the center of the machine body 2 in the width direction to the right or to the left is explained as a machine outward direction. In other words, the outward direction of the machine body is K2 in the machine width direction and away from the center of the machine body 2 in the width direction. The direction opposite to the outward direction is explained as a machine inward direction. In other words, the machine inward direction is the direction in the machine inward direction K2 that is closer to the center of the machine body 2 in the width direction.

As shown in FIG. 1, the traveling device 3 has a traveling frame 9 and a traveling mechanism 10. The traveling mechanism 10 is composed of a crawler-type traveling mechanism. In other words, the traveling device 3 is a crawler-type traveling device. The traveling mechanism 10 is provided on the left and right sides of the traveling frame 9. The traveling mechanism 10 has an idler 10A, a driving wheel 10B, a plurality of rolling wheels 10C, an endless crawler belt 10D, and a traveling motor M1 comprising a hydraulic motor. The idler 10A is located at the front of the traveling frame 9, and the driving wheels 10B are located at the rear portion of the traveling frame 9. A plurality of rolling wheels 10C are provided between the idler 10A and the driving wheels 10B. A crawler belt 10D is wound across the idler 10A, the driving wheels 10B and the rolling wheels 10C. The traveling motor M1 drives the driving wheels 10B to circulate the crawler belt 10D in a circumferential direction. A dozer device 7 is mounted at the front of the traveling device 3.

The machine body 2 is supported on the traveling frame 9 by means of a swivel bearing 8, which can be rotated (left and right) around the longitudinal axis center (the axis center extending in the vertical direction). The center of the swivel bearing 8 is the center of rotation of the machine body 2. The center of rotation of the machine body 2 is called the swivel axis center X1.

A prime mover E1 is mounted at the rear portion of the machine body 2. The prime mover E1 is, for example, a diesel engine. The prime mover E1 may be a gasoline engine, an LPG engine or an electric motor, or it may be a hybrid type having an engine and an electric motor.

Figure 3:
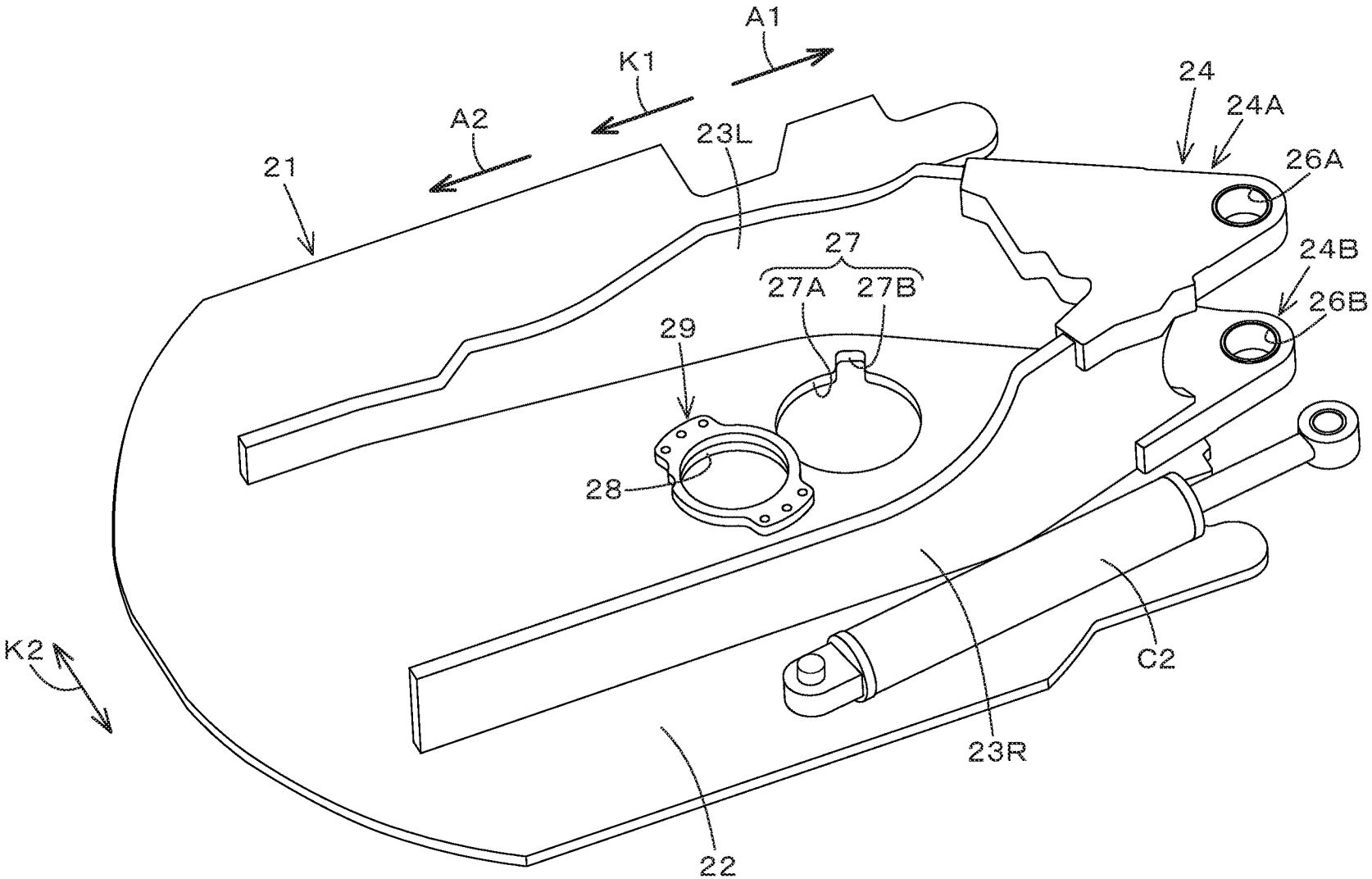
FIG. 3 is a perspective view of a turn frame.

As shown in FIG. 2 and FIG. 3, the machine body 2 has a swivel frame 21 which serves as a framework.

The swivel frame 21 has a swivel base (board) 22, a plurality of vertical ribs (first longitudinal rib 23L, second longitudinal rib 23R), and a support bracket (support member) 24. The swivel frame 21 also has brackets, stays, and the like for attaching equipment, tanks, and other parts to be mounted on the machine body 2.

The swivel base 22 is formed of a thick plate steel plate or the like and includes the bottom of the machine body 2. As shown in FIG. 1, the swivel base 22 is rotatably supported on the traveling device 3 via a swivel bearing 8, so that it can be rotated freely around the swivel axis X1. A weight 25 is mounted on the rear portion of the swivel board 22 and the prime mover E1 is mounted on the rear portion of the swivel board 22.

As shown in FIG. 2 and FIG. 3, the first longitudinal rib 23L and the second longitudinal rib 23R are members for reinforcing the swivel board 22 and are extended from the front to the rear. The first longitudinal rib 23L and the second longitudinal rib 23R are erected on the swivel board 22 and are juxtaposed at intervals in the machine width direction K2.

The support bracket 24 is provided at the front portion of the first longitudinal rib 23L and the second longitudinal rib 23R. The support bracket 24 is disposed at a position deviated to the right from the center of the swivel board 22 in the machine width direction K2. The support bracket 24 has a first support portion (support wall portion) 24A and a second support portion 24B, which are made of a plate material. The first support portion 24A is fixed to the front upper portion of the first longitudinal rib 23L and the second longitudinal rib 23R by welding or otherwise. A pin insertion hole 26A is formed in the front portion of the first support portion 24A in a vertical direction through the front portion of the first support portion 24A. The second support portion 24B is located below the first support portion 24A and is fixed to the front and lower portions of the first and second longitudinal ribs 23L and the second longitudinal ribs 23R and to the swivel base 22 by welding or otherwise. A pin insertion hole 26B is also formed in the front portion of the second support portion 24B in the vertical direction through the front portion of the second support portion 24B.

In the front of the swivel base 22 and between the first longitudinal rib 23L and the second longitudinal rib 23R, a first opening 27 is formed in the vertical direction in a penetrating manner. The first opening 27 has a circular main hole 27A and a notched hole 27B notched to extend radially outwardly from the main hole 27A.

As shown in FIG. 3, a second opening 28 is formed behind the first opening 27 in the swivel base plate 22 in the vertical direction in a penetrating manner. The second opening 28 is formed in a circular shape and has a motor mounting portion 29 around it. A swivel motor M2 including a hydraulic motor is mounted in the motor mounting portion 29 (see FIG. 2). The swivel motor M2 is a motor for driving the machine body 2 around the swivel axis center X1.

As shown in FIG. 1, a swing bracket (pivoting member) 14 made of cast iron is mounted on the support bracket 24, pivoting freely (left and right) around the vertical axis center. The swing bracket 14 has a working device 4 mounted on the swing bracket 14.

As shown in FIG. 1, the working machine 4 is a device capable of excavation work and has a boom 15, an arm 16, and a bucket (working tool) 17. The base of the boom 15 is pivotally pivoted to the swing bracket 14 around a transverse axis (the axis center extending in the machine width direction K2). This allows the boom 15 to pivot freely up and down. The arm 16 is pivotally pivoted to the end of the boom 15 around a horizontal axis. This allows the arm 16 to pivot back and forth or up and down freely. A bucket 17 is provided on the end side of the arm 16 for squeezing and dumping operations. The working machine 1 can be provided with other working tools (hydraulic attachments) that can be driven by a hydraulic actuator instead of or in addition to the bucket 17. Examples of these other working tools are hydraulic breakers, hydraulic crushers, angle brooms, earth augers, pallet forks, sweepers, mowers, snow blowers, and the like.

The swing bracket 14 is pivoted freely by the stretching and shortening of the swing cylinder C2 (see FIG. 2) provided on the right side of the machine body 2. The boom 15 is pivoted freely by the stretching and shortening of the boom cylinder C3. The arm 16 is pivotally pivotable by stretching and shortening of the arm cylinder C4. The bucket 17 is made free to scoot and dump by stretching and shortening the bucket cylinder (working tool cylinder) C5. The swing cylinder C2, the boom cylinder C3, the arm cylinder C4, and the bucket cylinder C5 are composed of a hydraulic cylinder (hydraulic actuator).

Figure 4:
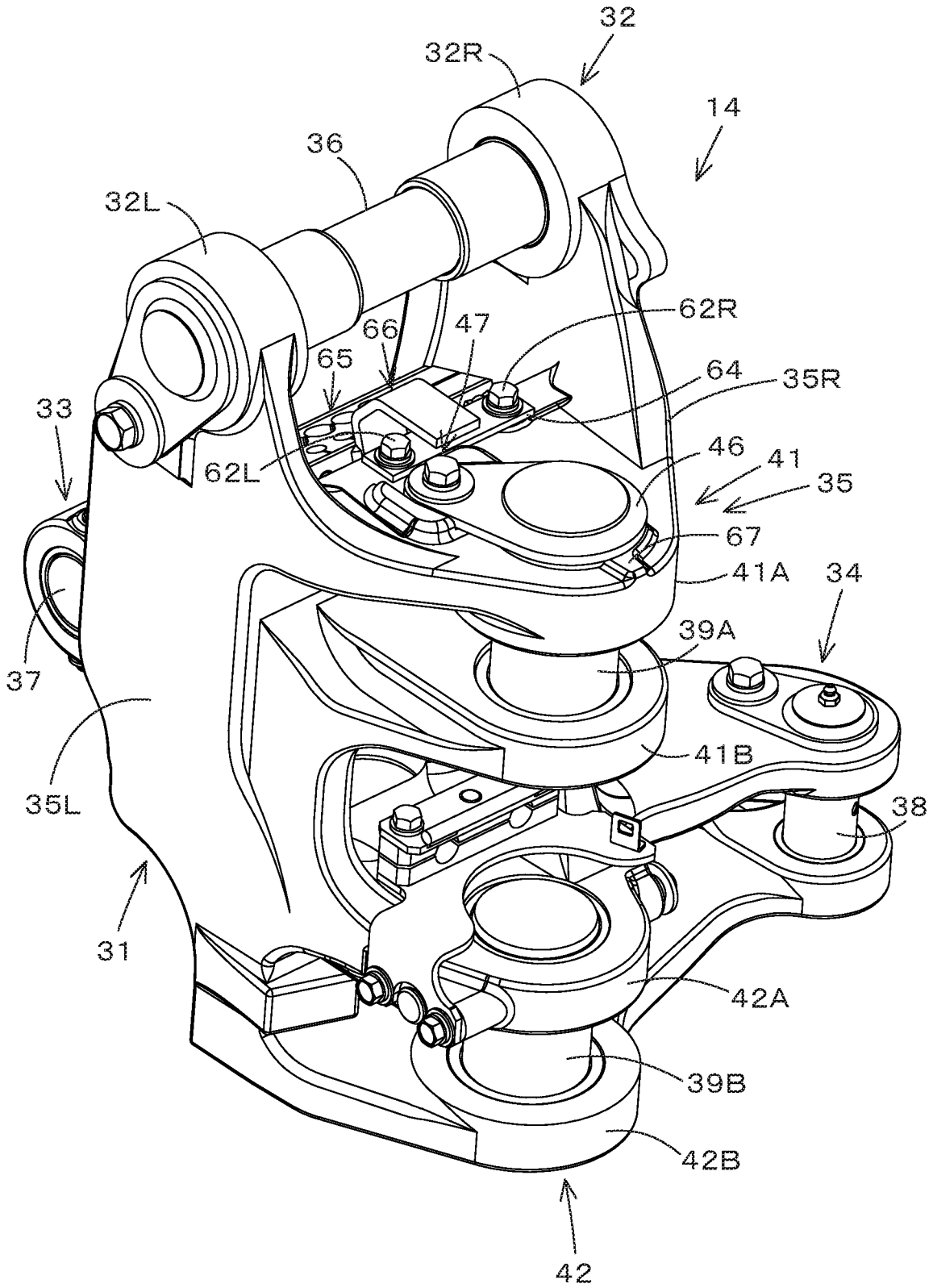
FIG. 4 is a perspective view of a swing bracket.
Figure 5:
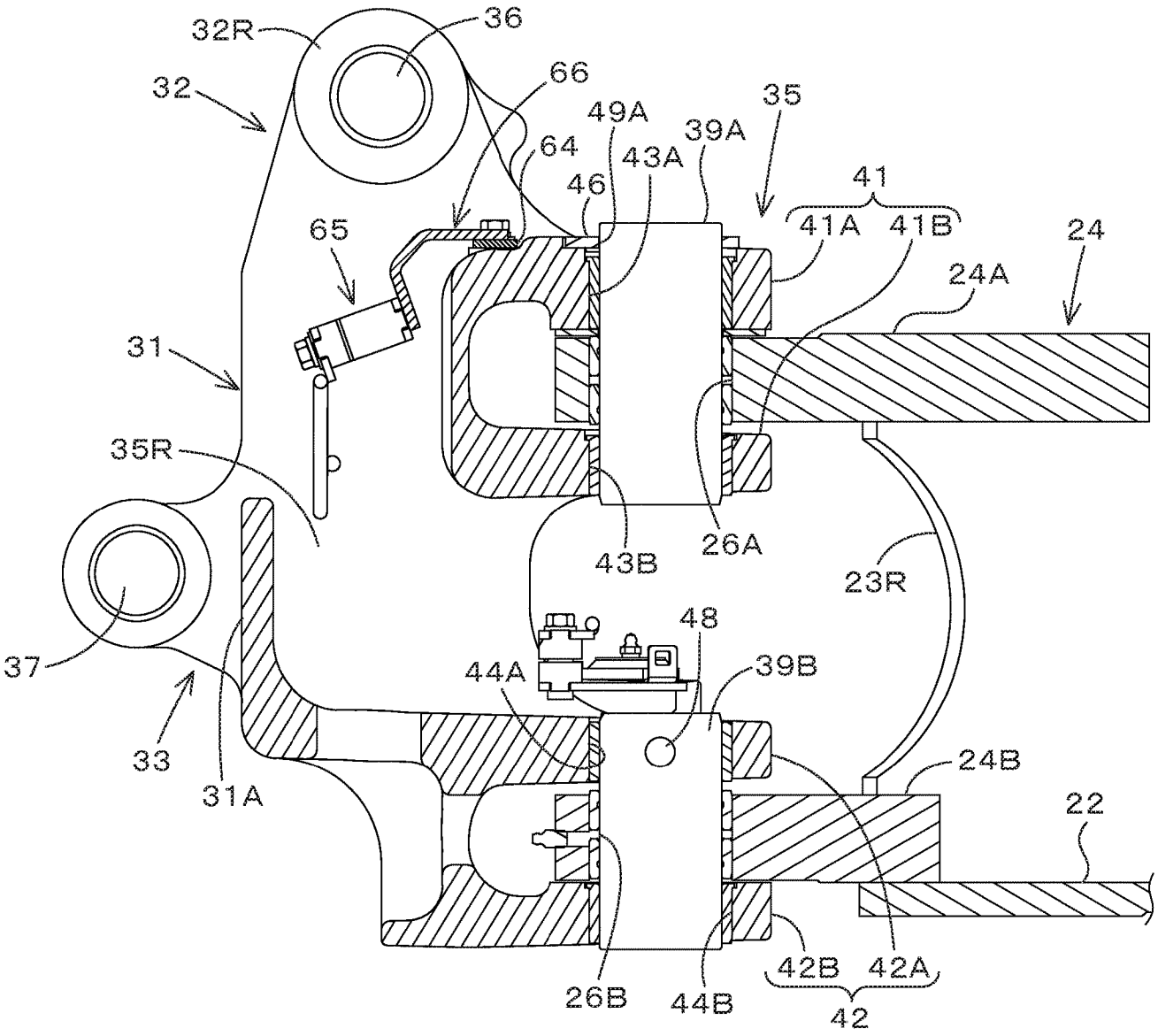
FIG. 5 is a cross section view of a side surface of a swing bracket connected to a support bracket.

As shown in FIG. 4 and FIG. 5, the swing bracket 14 has a main body portion 31, a boom connector portion 32, a first cylinder connector portion 33, a second cylinder connector portion 34, and a pivot connector portion 35.

The main body portion 31 includes a left side wall portion 31L and a right side wall portion 31R connected by a connecting wall portion 31A. The boom connector portion 32 is the portion to which the base of the boom 15 is pivotally connected. The boom connector portion 32 has a first portion 32L on the upper portion of the side wall portion 31L and a second portion 32R on the upper portion of the side wall portion 31R. A connector pin 36 having an axis center in the machine width direction K2 is provided across the first portion 32L and the second portion 32R. The base of the boom 15 is rotatably supported on this connector pin 36 around the axis center.

The first cylinder connector portion 33 is provided in a forward protruding manner at the front lower portion of the main body 31. A cylinder pin 37 is provided in this first cylinder connector portion 33. One end side (bottom side) of the boom cylinder C3 is pivoted to this cylinder pin 37.

The second cylinder connector portion 34 extends rightward from a lower portion of the side wall 31R of the main body 31. The tip portion of the piston rod of the swing cylinder C2 is pivotally connected to this second cylinder connector portion 34 via the cylinder pin 38.

As shown in FIG. 5, the pivotal connector portion 35 is provided in a rear protruding manner from the main body portion 31 and is rotatably connected to the support bracket 24 via a first pin (pin) 39A and a second pin 39B, which are rotatable around the vertical axis center. The pivot connection 35 has a first pivot portion 41 provided at the top portion of the main body 31 and a second pivot portion 42 provided at the bottom portion of the main body 31. The first pivot portion 41 has a first wall (rotational wall portion) 41A and a second wall 41B. The first wall 41A is spaced above the second wall 41B. A pin insertion hole 43A is formed in the first wall 41A in the vertical direction in a penetrating manner. A pin insertion hole 43B is also formed in the second wall 41B in a vertically penetrating manner in the second wall 41B. The first support portion 24A of the support bracket 24 is inserted between the first wall 41A and the second wall 41B. The first wall 41A is superimposed on the first support portion 24A. A first pin 39A is inserted through a bushing over the pin insertion hole 43A of the first wall 41A and the pin insertion hole 43B of the second wall 41B and the pin insertion hole 26A of the first support portion 24A.

The second pivot portion 42 has a third wall 42A and a fourth wall 42B. The third wall 42A is spaced above the fourth wall 42B. A pin insertion hole 44A is formed in the third wall 42A in an up and down direction through the third wall 42A. A pin insertion hole 44B is also formed in the fourth wall 42B in a vertically penetrating manner in the fourth wall 42B. A second support portion 24B of the support bracket 24 is inserted between the third wall 42A and the fourth wall 42B. A second pin 39B is inserted through a bushing over the pin insertion hole 44A of the third wall 42A and the pin insertion hole 44B of the fourth wall 42B and the pin insertion hole 26B of the second support portion 24B.

The above configuration allows the swing bracket 14 to be pivotally pivoted to the support bracket 24 via pins (first pin 39A, second pin 39B) inserted vertically across the support bracket (support member) 24 and the swing bracket (pivoting member) 14.

As shown in FIG. 4, the first pin 39A is detachable by means of a flange 46 secured to the first pin 39A and a retainer tool 47 which is attached to the swing bracket 14 by inserting the flange 46 and securing it with a screw fixation. As shown in FIG. 5, the second pin 39B is retained by a retainer pin 48 inserted across the second pin 39B and the third wall 42A.

Figure 6:
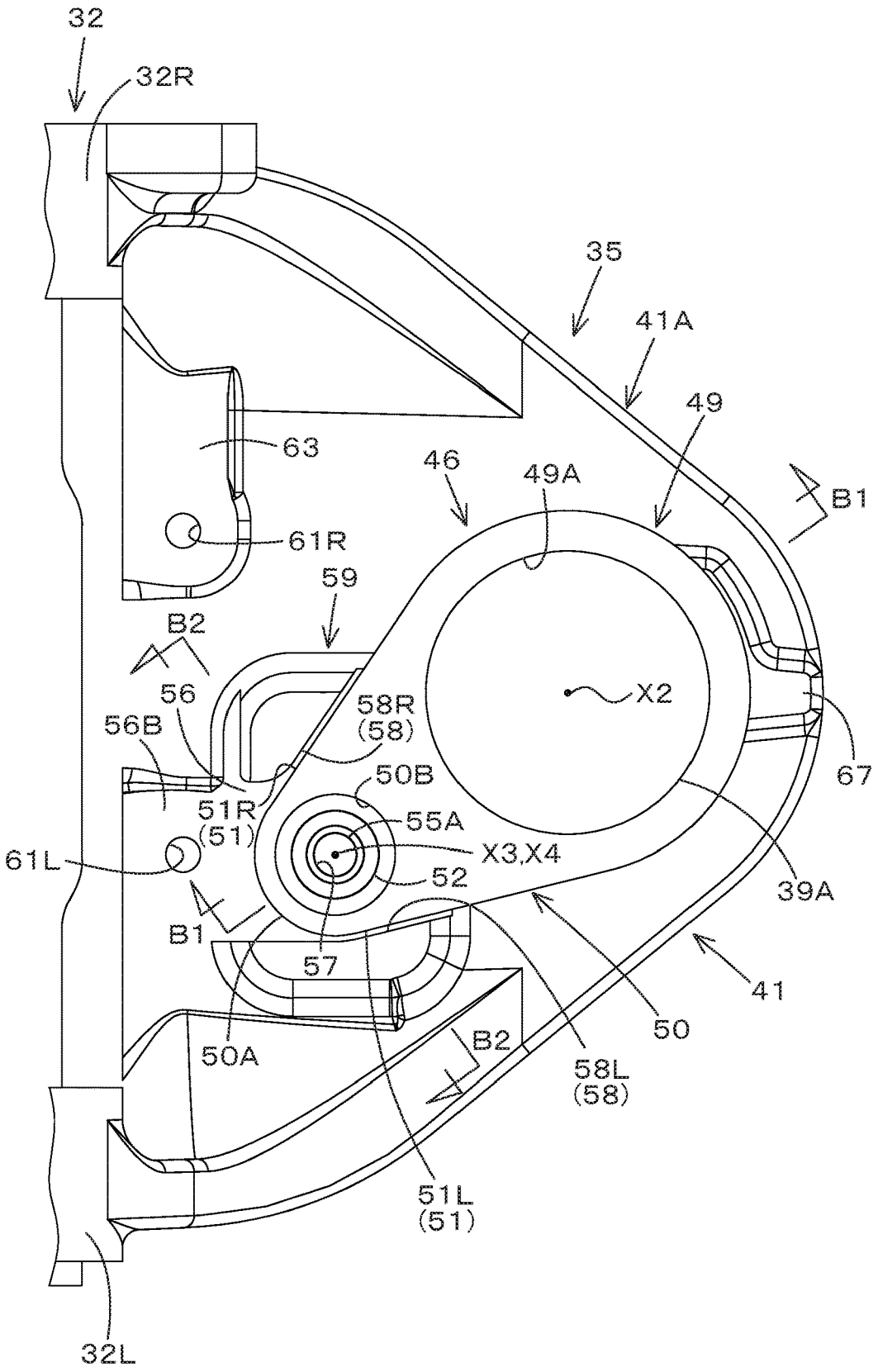
FIG. 6 is a plan view of an upper portion of a swing bracket.
Figure 7:
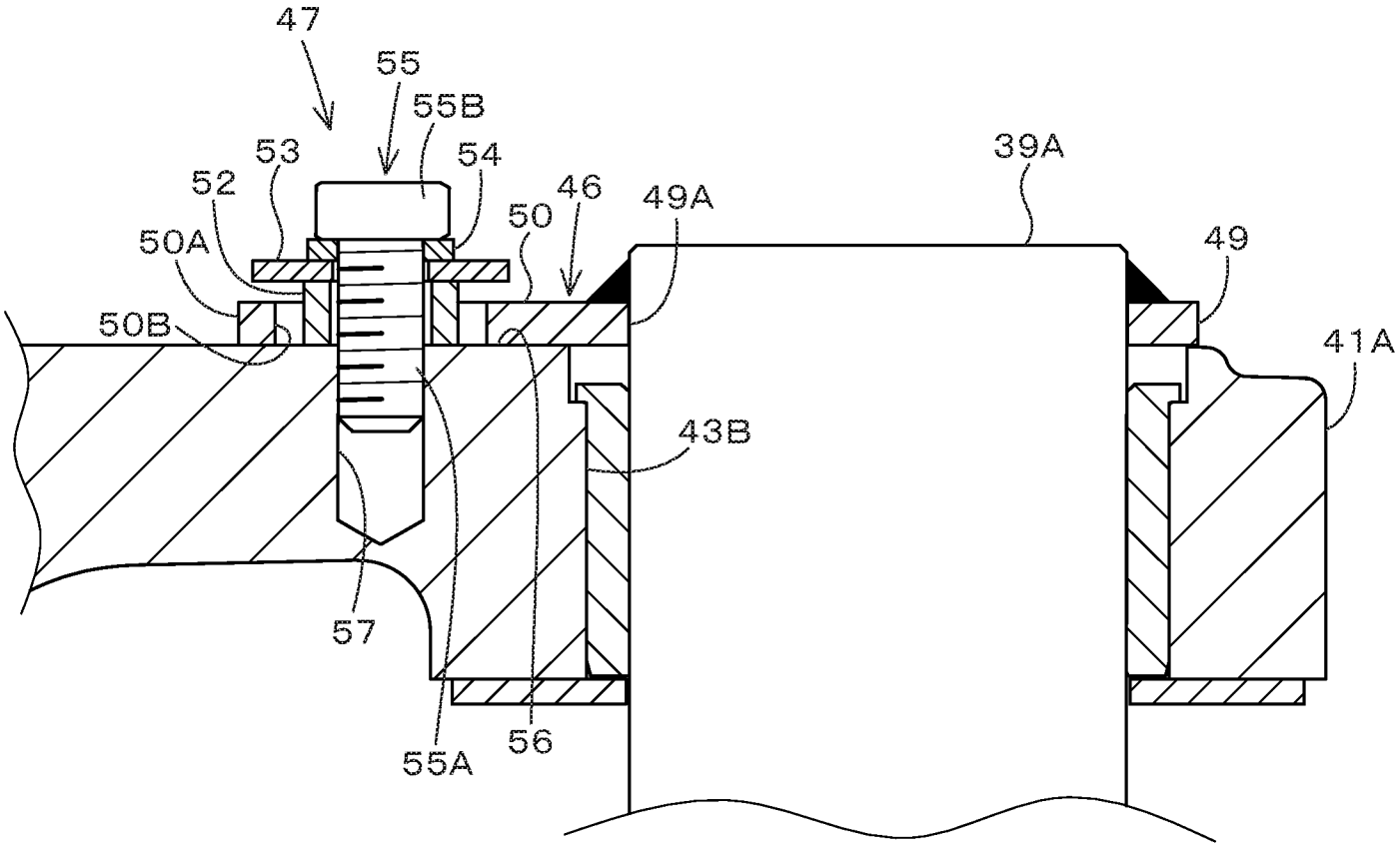
FIG. 7 is a cross section view in B1-B1 arrowed line of FIG. 6.

As shown in FIG. 6 and FIG. 7, the flange 46 includes a base portion 49 secured to the first pin 39A and a protruding portion 50 protruding radially outwardly from the base portion 49 to the first pin 39A. The base portion 49 has a hole 49A for insertion of the first pin 39A and is fixed to the upper end of the first pin 39A by welding or otherwise. The protruding portion 50 is formed progressively narrower as it extends from the base portion 49 to the protruding direction. The protruding portion 50 has an insertion hole 50B formed in the vicinity of the protruding end portion 50A, which is an end of the protruding side, in the vertical direction in a penetrating manner. The protruding portion 50 has a contact portion 51 including a first contact portion 51L and a second contact portion 51R. The first contact portion 51L includes a portion (for example, a left side) on one side (for example, the first rotation direction side) of the rotational direction of the first pin 39A (around an axis X2 of the first pin 39A) in the flange 46 (in the protruding portion 50). The second contact portion 51R includes a portion (for example, the right side) on the other side (the second rotational direction side) of the rotational direction around the first pin 39A (in the protruding portion 50) in the flange 46. The shape of the flange 46 shown in FIG. 6 and FIG. 7 is an example and is not limited to this and may be changed to other shapes.

Figure 8:
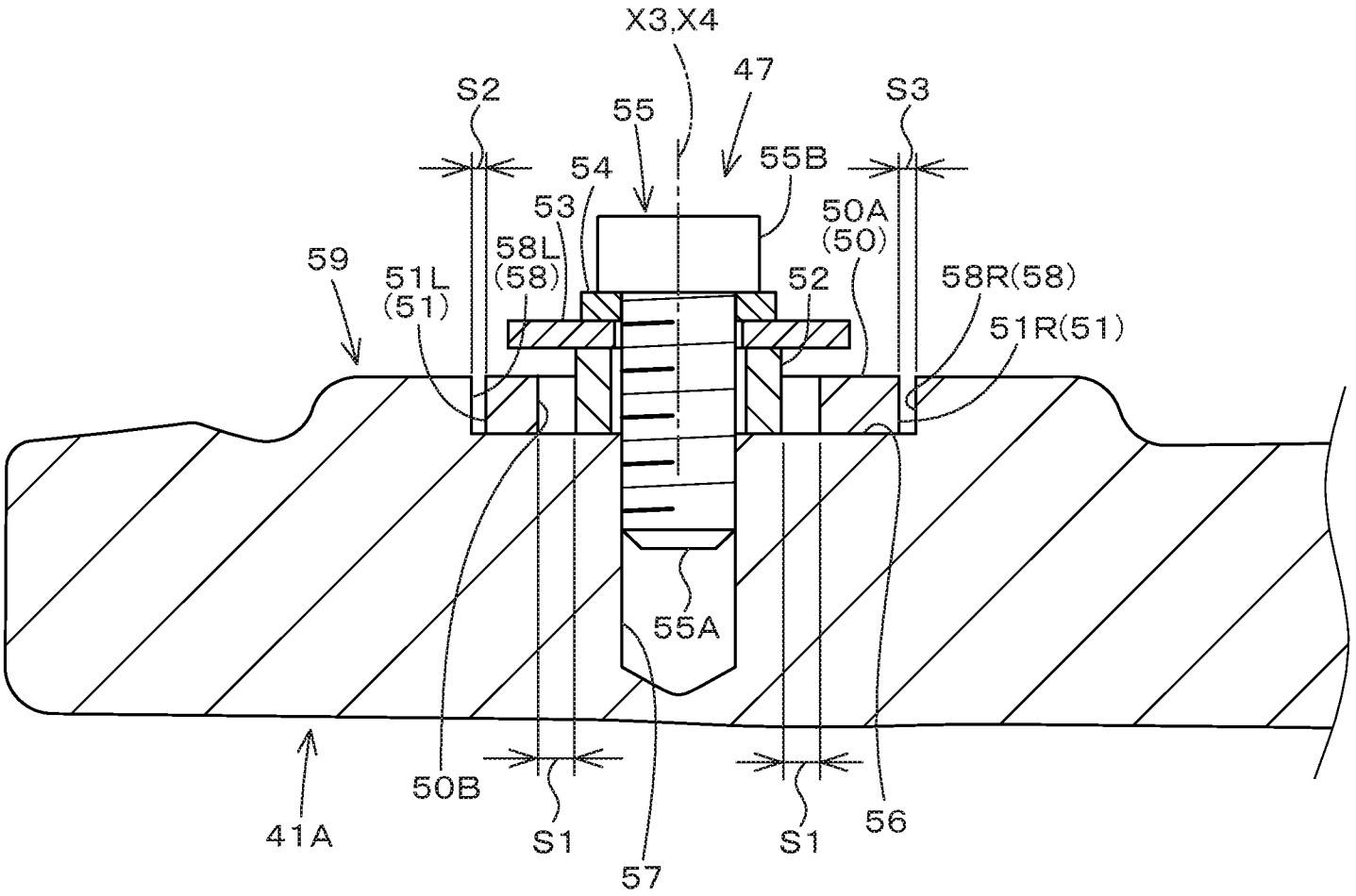
FIG. 8 is a cross section view in B2-B2 arrowed line of FIG. 6.

As shown in FIG. 7 and FIG. 8, the retainer tool 47 has a collar 52, a first washer 53, a second washer 54, and a retainer bolt 55. The first washer 53 and the second washer 54 may be used as necessary, and one or both of the first washer 53 and the second washer 54 may be omitted. A configuration that realizes the functions of the first washer 53 and/or the second washer 54 may be provided on a portion of the retainer bolt 55, and the first washer 53 and/or the second washer 54 may be integrated into the retainer bolt 55. A spring washer may also be used as the first washer 53 and/or the second washer 54.

The collar 52 is cylindrical in shape and is inserted into the insertion hole 50B in the vertical direction. The lower end portion of the collar 52 contacts a processed surface 56, which is a surface on which the flange 46 is contacted (placed) in surface contact with the flange 46 in the first wall (rotational wall portion) 41A of the first pivot portion 41. The upper portion of the collar 52 protrudes above the flange 46 (protruding portion 50).

The first washer 53 is formed with a larger diameter than the insertion hole 50B and contacts the upper surface portion of the collar 52. The second washer 54 is in contact with the upper surface of the first washer 53.

The retainer bolt 55 has a threaded shaft portion 55A and a head portion 55B. The threaded shaft portion 55A is formed by cutting a male thread on the outer circumference of a cylindrical shaped member. The retainer bolt 55 (the threaded shaft portion 55A) is threaded into the threaded hole 57 formed in the processed surface 56 (the first wall 41A) by inserting the second washer 54, the first washer 53 and the collar 52. The threaded hole is a hole with a female thread formed on the inner surface of the cylindrical hole.

The retainer bolt 55 is screwed into the threaded hole 57, which secures the retainer tool 47 to the swing bracket 14. This regulates the upward movement of the flange 46 and detachment of the first pin 39A.

As shown in FIG. 6, a regulator portion 58 is provided on the upper surface of the first wall 41A (swing bracket 14) that regulates the rotation of the flange 46 around the first pin 39A by the contact portion 51 of the flange portion 46.

Figure 9:
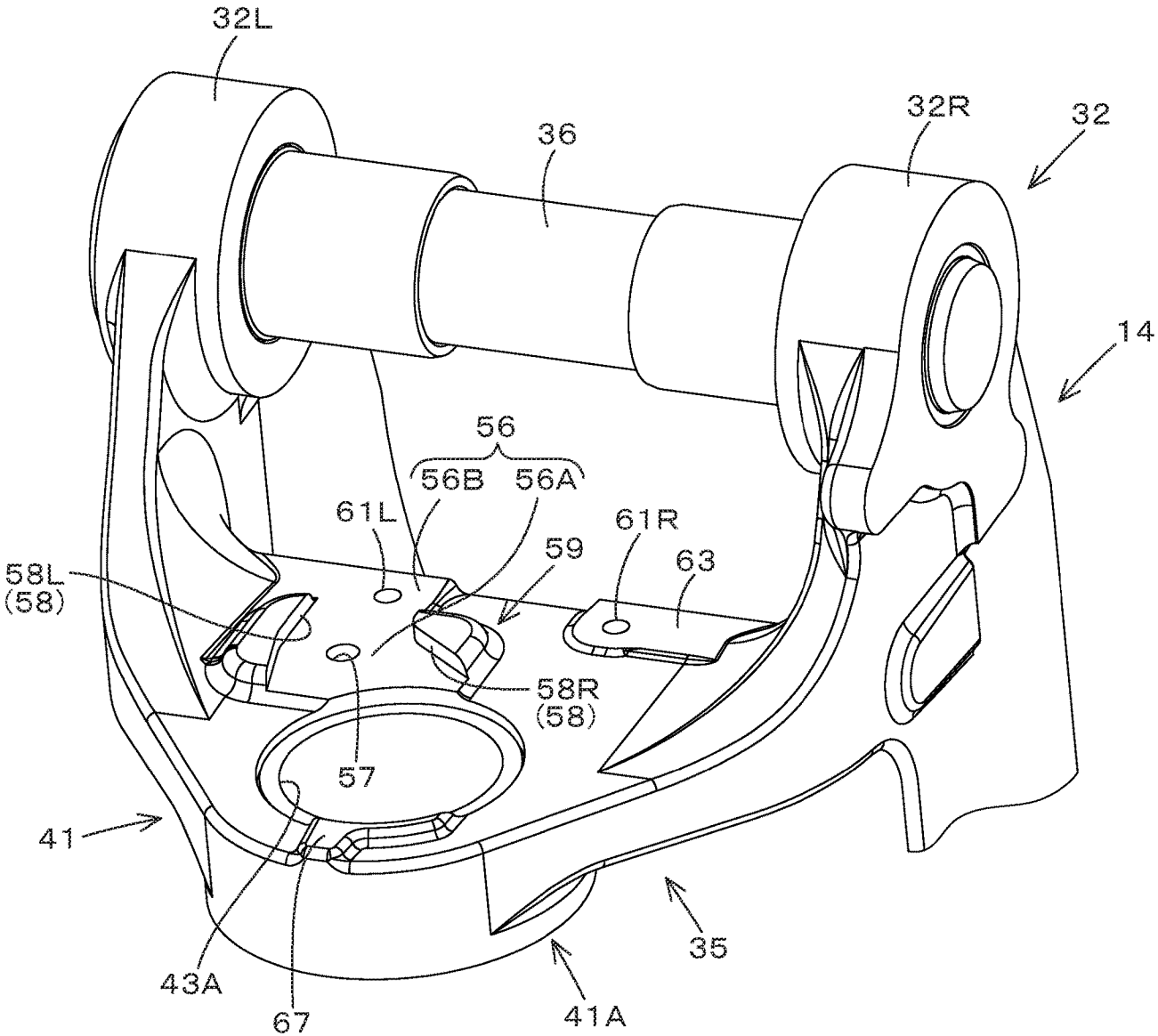
FIG. 9 is a perspective view of an upper portion of a swing bracket in a state where a pin is not inserted.
Figure 10:
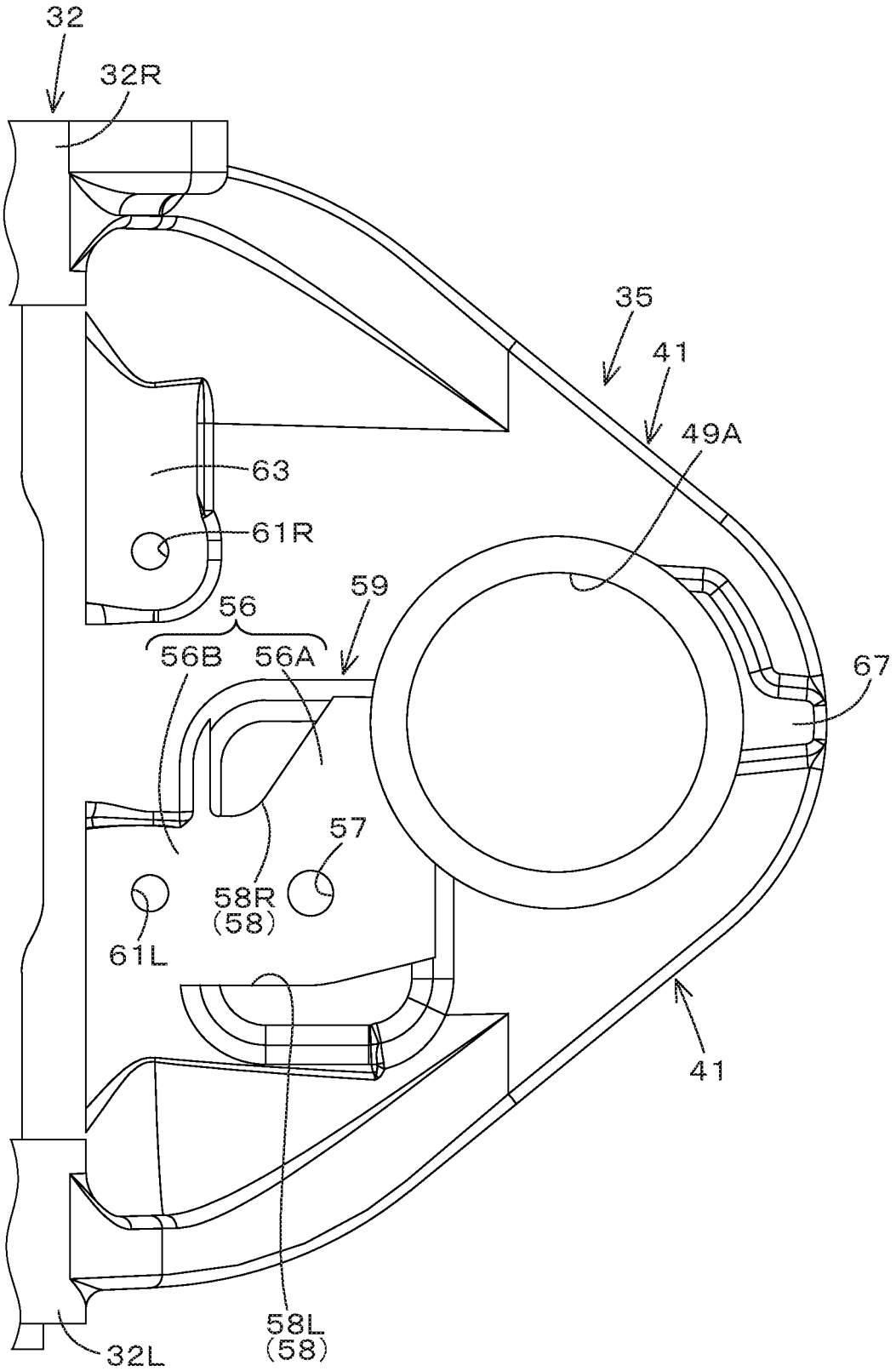
FIG. 10 is a plan view of an upper portion of a swing bracket in a state where a pin is not inserted.

As shown in FIG. 9 and FIG. 10, the regulator portion 58 includes a first portion 58L where the first contact portion 51L contacts, and a second portion 58R where the second contact portion 51R contacts. The first portion 58L and the second portion 58R are formed together when the bulging portion 59 formed in the swing bracket 14 is cut away to form the processed surface 56. In detail, the first portion 58L and the second portion 58R are composed of a bulging portion 59 raised upwardly on the upper surface of the first wall 41A when the swing bracket 14 is formed by casting, and the bulging portion 59 is scraped off to form a flattened processed surface 56 by the vertical surfaces formed together to form the first portion 58L and the second portion 58R include surfaces in the vertical direction continuous with the processed surface 56 and extending upwards from the processed surface 56. That is, the first portion 58L and the second portion 58R include a vertical surface continuous with the processed surface 56 and extending upwardly from the processed surface 56.

As shown in FIG. 6, the protruding portion 50 of the flange 46 is placed on the processed surface 56 and is sandwiched between the first portion 58L and the second portion 58R. The first portion 58L corresponds (opposite) in a horizontal direction to the first contact portion 51L. The second portion 58R corresponds in a horizontal direction with the second contact portion 51R (opposed to each other). As shown in FIG. 8, with the center X3 of the insertion hole 50B coinciding with the center X4 of the collar 52 (see FIG. 6), the clearance S1 between the inner surface of the inner surface of the insertion hole 50B and the outer surface of the collar 52 is larger than the clearance S2 between the first contact portion 51L and the first portion 58L, and the clearance S3 between the second contact portion 51R and the second portion 58R.

Figure 11:
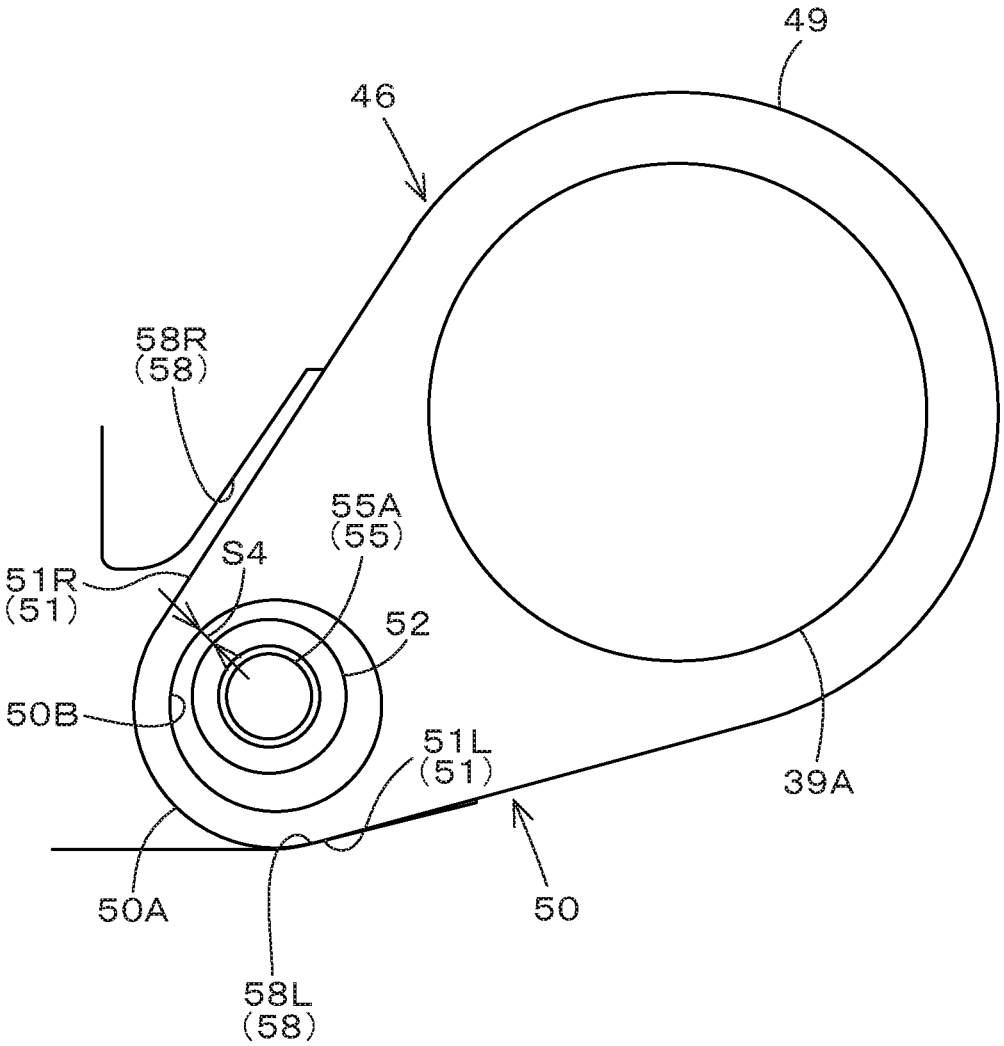
FIG. 11 is a plan view illustrating operation of a flange.
Figure 12:
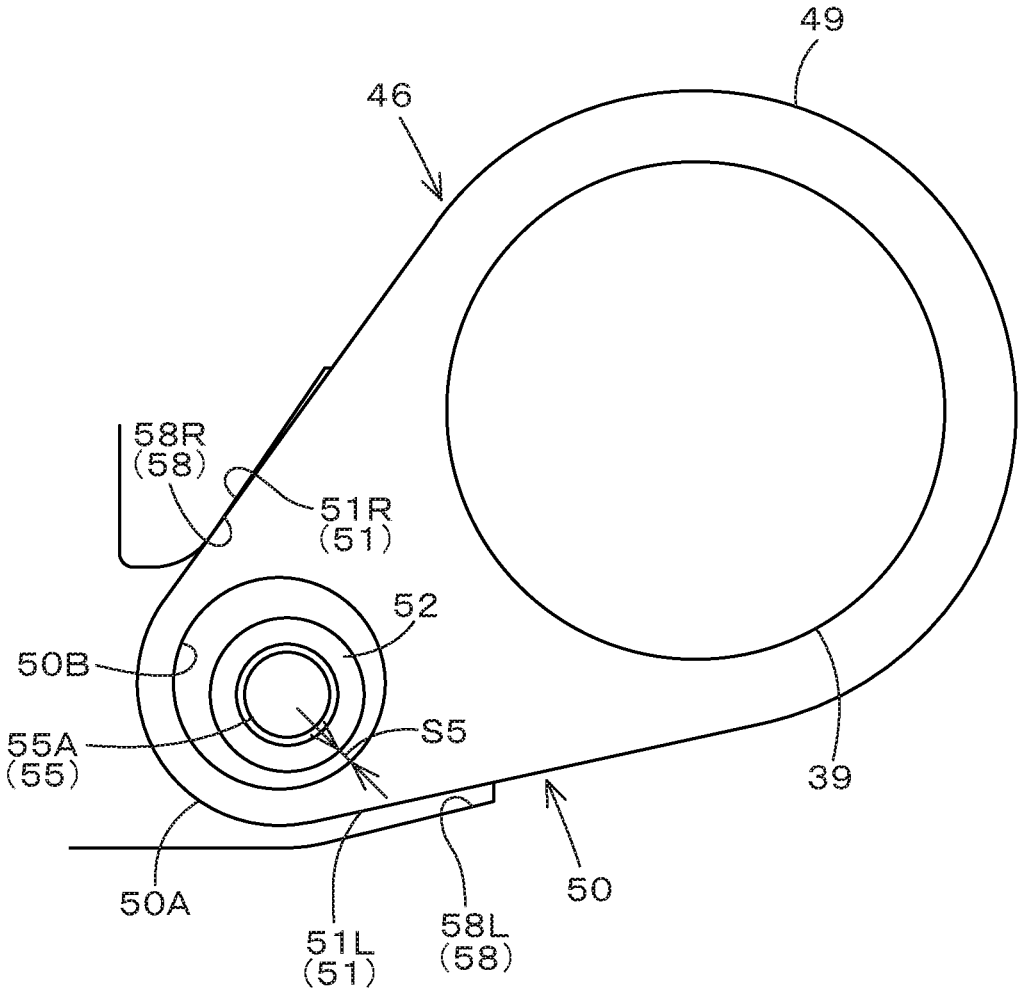
FIG. 12 is a view illustrating another operation of a flange.

FIG. 11 shows a state in which the first percussion portion 51L is in contact with the first portion 58L. In this state, there is a clearance S4 between the retainer tool 47 and the inner surface of the insertion hole 50B. FIG. 12 also shows a state in which the second percussion portion 51R is in contact with the second portion 58R. Even in this state, there is a clearance S5 between the retainer tool 47 and the inner periphery of the insertion hole 50B. That is, rotation of the flange 46 around the first pin 39A is regulated by the contact portion 51 with the control portion 58 with clearances S4 and S5 between the outer periphery of the collar 52 (the retainer tool 47) and the inner periphery of the insertion hole 50B. As a result, even when a force is applied to the first pin 39A in the direction of rotating the first pin 39A about its axis center X2 during excavation work or the like, this force does not act on the retainer tool 47 through the flange 46. Hence, torque reduction of the retainer bolt 55 (retainer tool 47) due to the flange 46 coming into contact with the collar 52 can be prevented.

In the present embodiment, the first pin 39A is extracted and secured by attaching the retainer bolt 55 (retainer tool 47) to the swing bracket 14 (turn member) by screw fixation, but the present invention is not limited to this. For example, the present invention is provided with a two-legged support bracket 24, the swing bracket 14 is inserted between the two-legged portions, the swing bracket 14 is inserted between the two-legged portions, and the contact portion 51 of the flange portion 46 contacts the upper surface of the support bracket 24, and the first pin 39A may be retained by attaching the retainer bolt 55 to the support bracket 24 (support member) in a screwing manner.

As shown in FIG. 9 and FIG. 10, the processed surface 56 has a second mounting surface 56B continuous with the first mounting surface 56A on which the flange 46 is placed. A threaded hole 61L is formed in the second mounting surface 56B. A third mounting surface 63 is formed to the right of the second mounting surface 56B. A screw hole 61R is also formed in the third mounting surface 63. As shown in FIG. 4, an attachment plate 64 is placed over the second mounting surface 56B and third mounting surface 63. The mounting plate 64 is secured to the first wall 41A by bolts 62L threaded into the threaded holes 61L and bolts 61R threaded into the threaded holes 61R.

As shown in FIG. 5, the mounting plate 64 forms portion of the bracket member 66 that supports the hose clamp 65. The hose clamp 65 is a member that supports a hydraulic hose that is distributed from the machine body 2 side through the first support portion 24A and the second support portion 24B to the working tool 4.

As shown in FIG. 6, an indicator portion 67 is provided at the rear portion of the upper surface of the swing bracket 14 to indicate the orientation of the swing bracket 14. The indicator portion 67 is a marker indicating that the swing bracket 14 is pointing straight forward (the swing bracket 14 is located in the middle of the swinging range to the left and right). The indicator portion 67 indicates that the swing bracket 14 is pointing straight ahead with the swing bracket 14 pointing backward (the state shown in FIG. 6).

Figure 13:
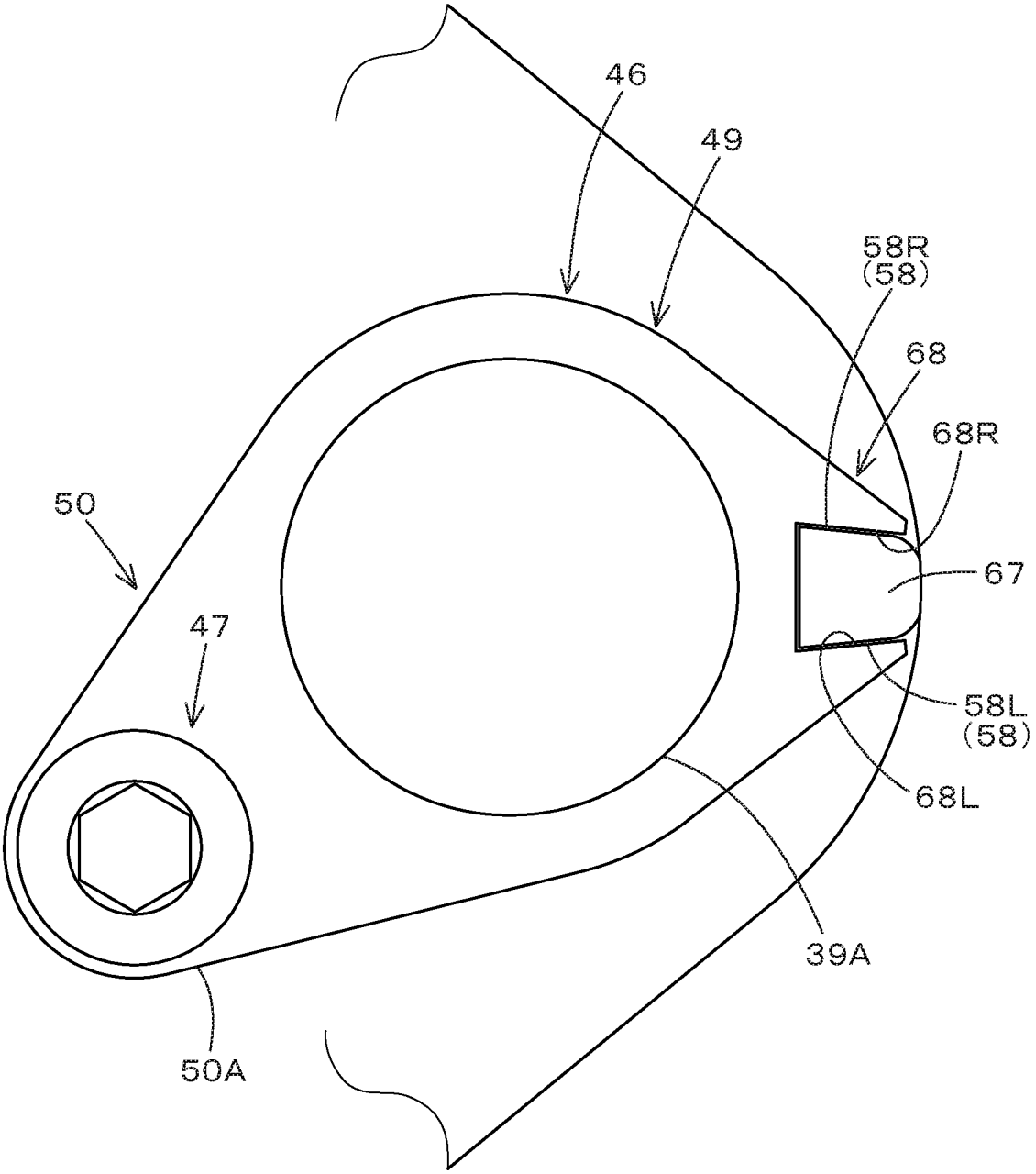
FIG. 13 is a plan view illustrating a modified example of a regulator portion.

The contact portion 51 and the regulator portion 58 are not limited to the above configuration. For example, as shown in FIG. 13, a regulator portion 58 may be provided in the indicator portion 67 and a contact portion 68 may be provided in the base portion 49 of the flange 46, as shown in FIG. 13. The contact portion 68 is formed in the form of two halves flanking the indicator portion 67. In this case, one side of the indicator portion 67 (for example, the left side) is the first portion 58L of the regulator portion 58, and the other side of the indicator portion 67 (for example, the right side) is the second portion 58R of the regulator portion 58. The first contact portion 68L of the contact portion 68 is a surface facing the first portion 58L, and the second contact portion 61R is a surface facing the second portion 58R.

However, as shown in FIG. 6, the distance from the axial center X2 of the first pin 39A to the protruding end portion 50A (the portion where the retainer tool 47 is disposed) is farther than the distance from the axial center X2 of the first pin 39A to the index portion 67. Therefore, the amount of movement when the flange 46 rotates around the first pin 39A is greater for the contact portion 51 at the protruding portion 50 than for the contact portion 68 at the base portion 49 of the flange 46. Therefore, it is easier to manage the gap between the contact portion 51 and the regulator portion 58 to make the gap between the contact portion 51 and the regulator portion 58 narrower than the clearance S1 between the inner surface of the inner surface of the insertion hole 50B and the outer surface of the collar 52 when the contact portion 51 is provided at a position far from the axis X2 of the first pin 39A. It is also more advantageous to provide the contact portion at the protruding end portion 50A, which eliminates the need to change the shape of the flange 46.

Figure 14:
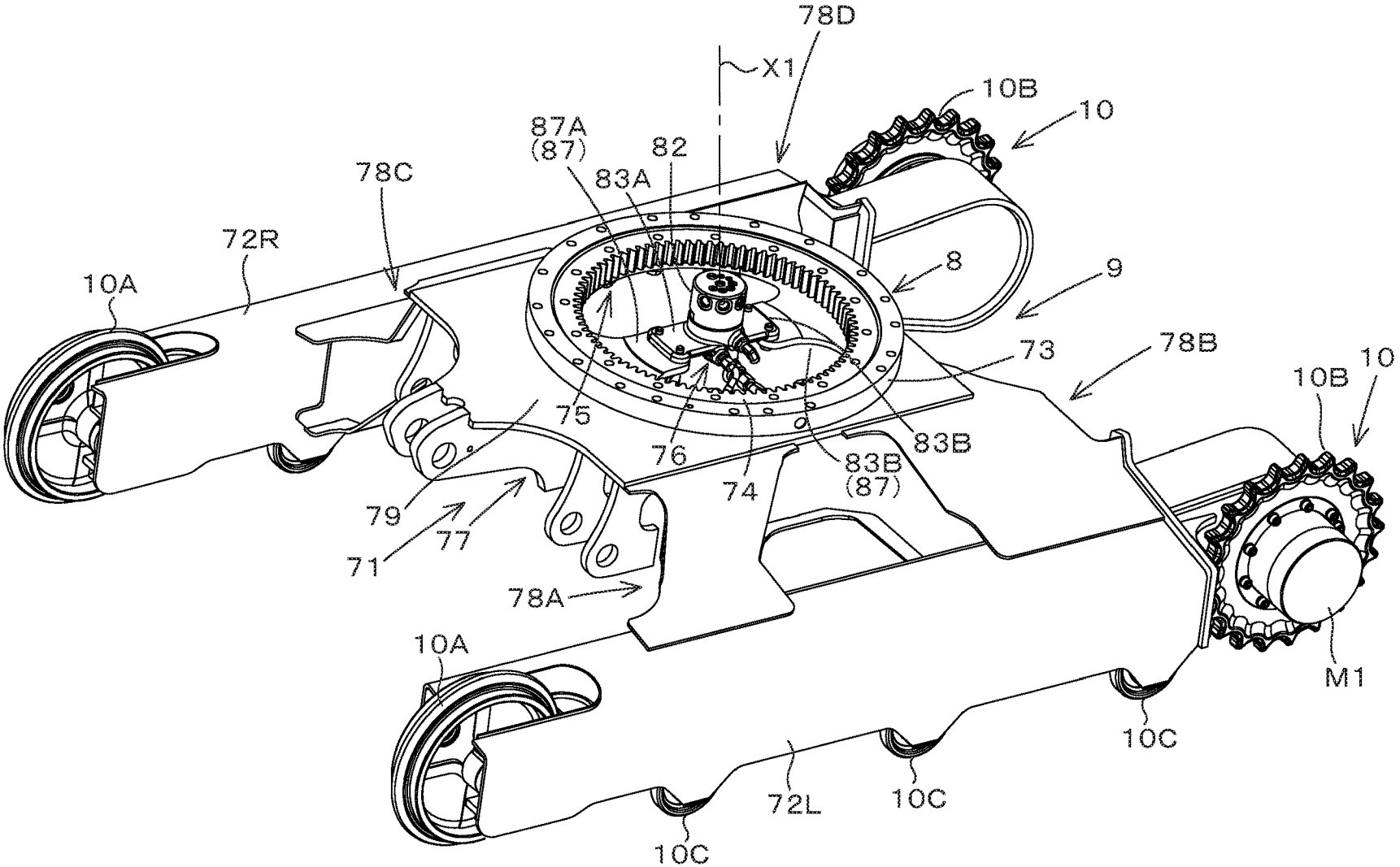
FIG. 14 is a perspective view of a traveling device.

As shown in FIG. 14, the traveling frame 9 has a center frame 71, a first side frame 72L on the left side of the center frame 71, and a second side frame 72R on the right side of the center frame 71. The machine body 2 is rotatably supported on the center frame 71 via a swivel bearing 8. The first side frame 72L and the second side frame 72R are provided with a traveling mechanism 10.

Figure 15:
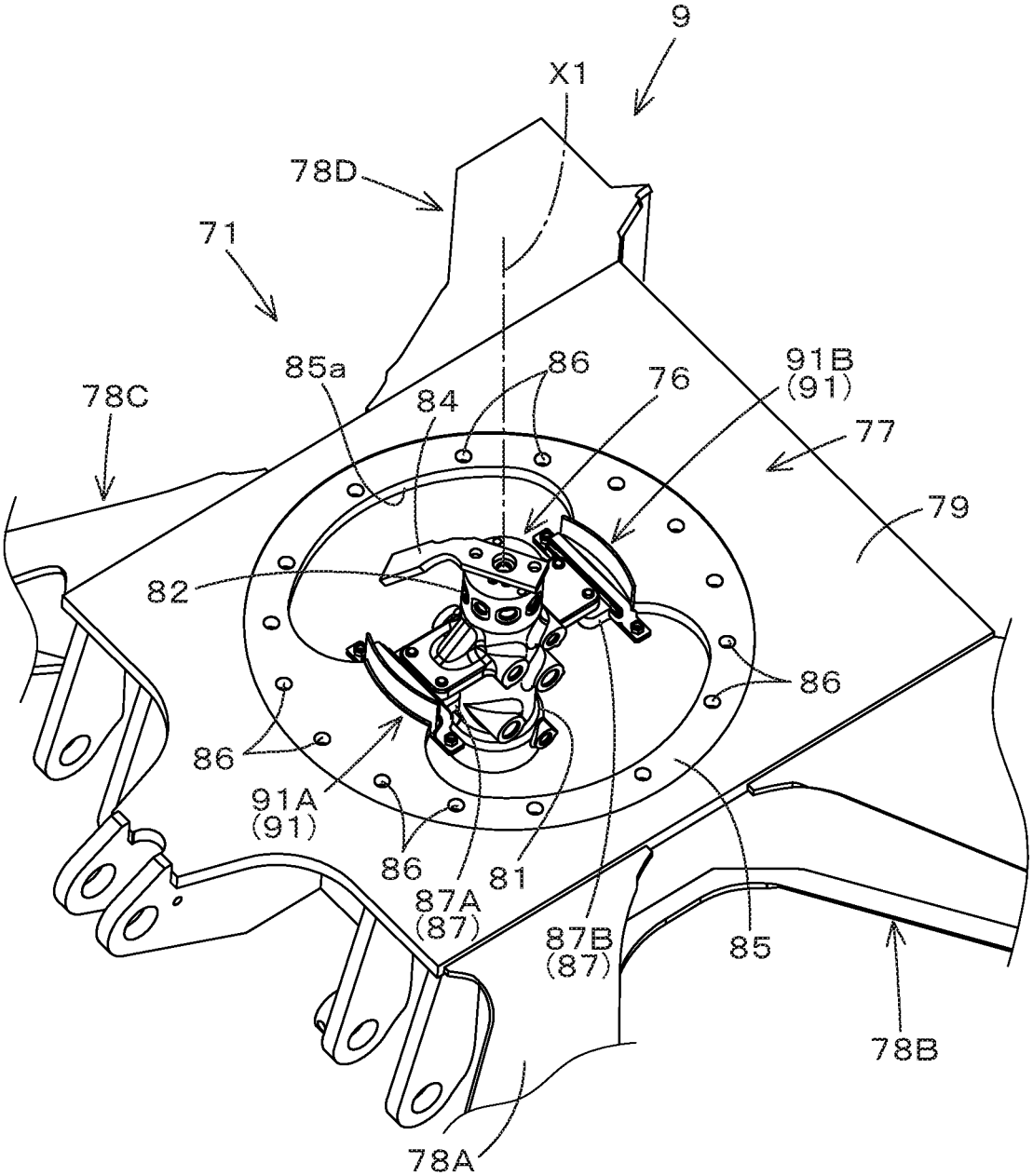
FIG. 15 is a perspective view of a traveling frame.

As shown in FIG. 14 and FIG. 15, the center frame 71 has a central frame portion 77 and four support legs 78A to 78D extending from the central frame portion 77. The central frame portion 77 has a top plate 79 comprising a top surface of the central frame portion 77. The support legs 78A and 78B connect the central frame portion 77 to the first side frame 72L. The support legs 78C and 78D connect the central frame portion 77 to the second side frame 72R.

Figure 17:
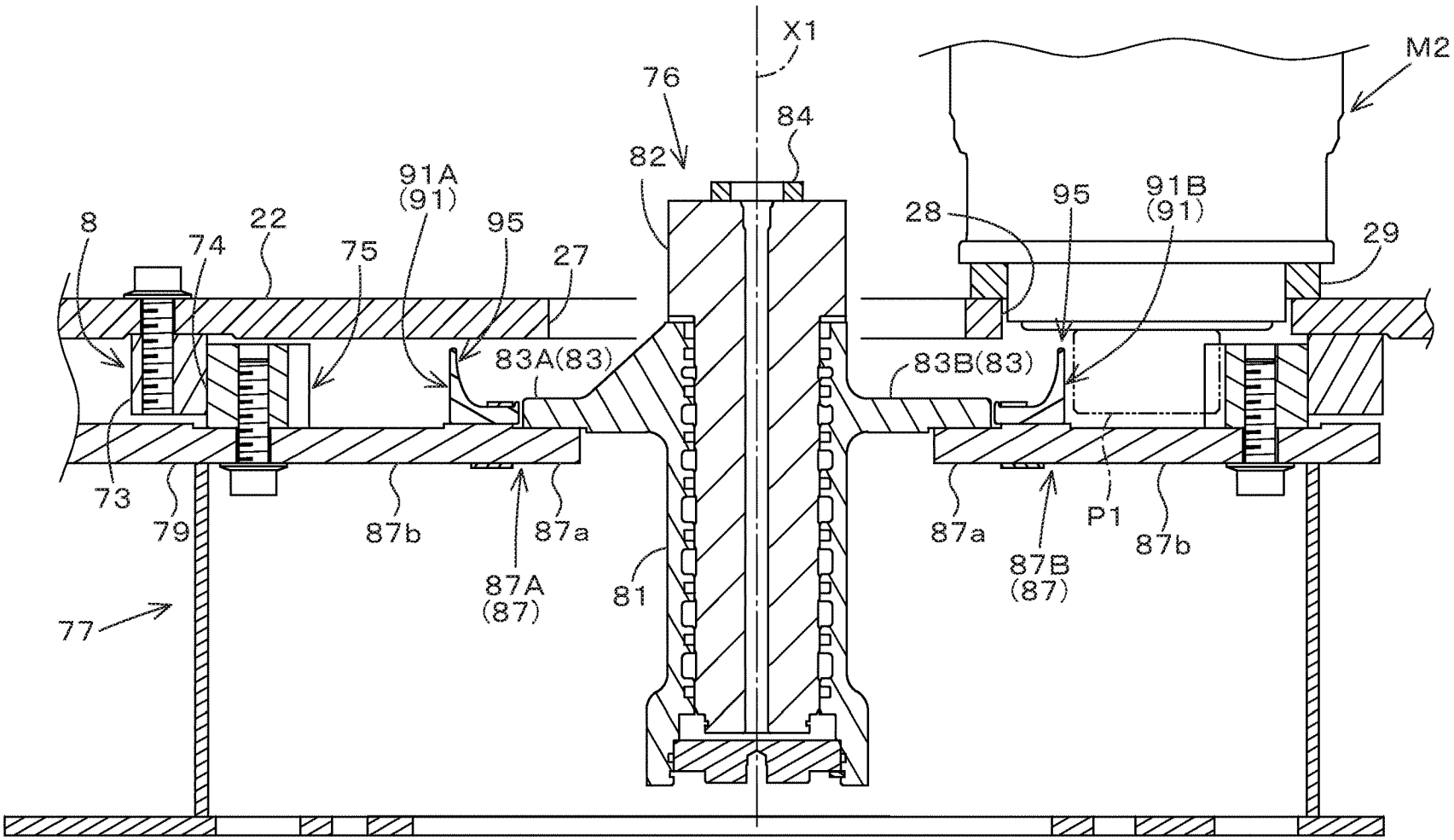
FIG. 17 is a cross section view illustrating a side surface of an arrangement portion of a swivel joint.

As shown in FIG. 14, the swivel bearing 8 has an outer ring 73, an inner ring 74 provided on the inner side of the outer ring 73 through a ball to rotate freely around the swivel axis center X1, and an inner tooth gear 75 formed on the inner side of the inner ring 74. As shown in FIG. 17, the outer ring 73 is bolted to the swivel base 22. That is, the outer wheel 73 is attached to the machine body 2. The inner wheel 74 is bolted to the center frame 71. That is, the inner wheel 74 is attached to the traveling device 3.

As shown in FIG. 17, the swivel motor M2 has a swivel pinion P1 attached to the swivel motor M2. The swivel pinion P1 is disposed on the lower side of the swivel base 22 through the second opening 28 and engages an inner tooth gear 75. The swivel pinion P1 is driven by the swivel motor M2 to rotate around the vertical axis center. Therefore, when the swivel pinion P1 is driven by the swivel motor M2, the swivel pinion P1 moves in the circumferential direction of the swivel bearing 8 while engaging the inner tooth gear 75. This causes the machine body 2 to rotate around the swivel axis X1.

As shown in FIG. 14 to FIG. 17, a swivel joint 76 is disposed at the position of the swivel axis center X1. The swivel joint 76 is a swivel joint that allows the supply and discharge of hydraulic fluid between the hydraulic actuators on the travel device 3 side and the control valve on the machine 2 side. The control valve is a valve unit that consolidates each control valve that controls each hydraulic actuator on the working machine 1.

As shown in FIG. 17, the swivel joint 76 has an outer sleeve 81, an inner shaft 82, and an attachment wall 83. The outer sleeve 81 is formed in a cylindrical shape and is disposed on the lower side of the swivel base 22. The inner shaft 82 is inserted into the outer sleeve 81 with the ability to rotate freely around a vertical axis. The rotational axis center of the inner shaft 82 is aligned with the swivel axis center X1. The upper portion of the inner shaft 82 protrudes above the swivel base 22 through the first opening 27 (main hole 27A). On the upper surface of the inner shaft 82, an engagement member 84 is mounted on the upper surface of the inner shaft 82, which engages the swivel base 22 and rotates integrally with the swivel base 22. Thus, the inner shaft 82 rotates integrally with the swivel base plate 22.

The attachment wall 83 includes a first attachment wall 83A and a second attachment wall 83B. The first attachment wall 83A and the second attachment wall 83B are integrally formed in the upper portion of the outer sleeve 81. The first attachment wall 83A protrudes from the outer sleeve 81 in one horizontal direction (forward). The second attachment wall 83B protrudes from the outer sleeve 81 in the other (rear) direction opposite to one of the above. There should be at least one attachment wall 83.

Figure 16:
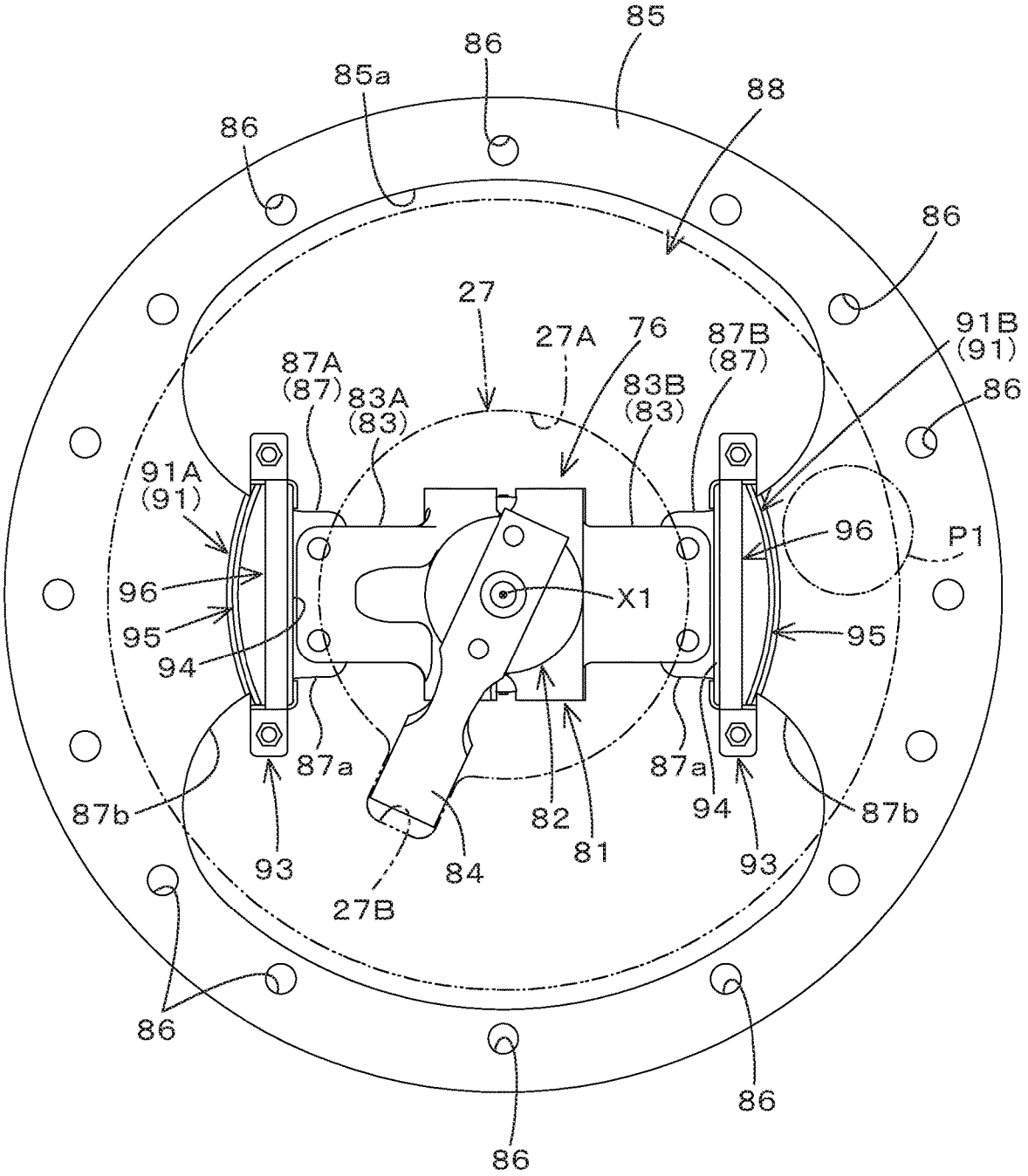
FIG. 16 is a plan view of a center portion of a traveling frame.

As shown in FIG. 15 and FIG. 16, the engagement member 84 is formed by a plate material and protrudes from the upper surface of the inner shaft 82. The protruding portion of the engagement member 84 is formed in an inclined shape that shifts downwardly as it extends outwardly in the radial direction of the swivel joint 76. The lower portion of the protruding portion of the engaging member 84 is inserted into the notch hole 27B. The engagement member 84 engages the notched hole 27B, causing the inner shaft 82 to rotate integrally with the swivel base 22.

As shown in FIG. 15, an inner ring attachment portion 85 is provided on an upper surface of the top plate 79 to which the inner ring 74 of the swivel bearing 8 is attached. The inner ring attachment portion 85 is provided with a plurality of bolt insertion holes 86 to which bolts for fixing the inner ring 74 are inserted at intervals in the circumferential direction. The bolt insertion holes 86 include an annular edge formed through the top plate 79.

As shown in FIG. 16, the top plate 79 (traveling device 3) has a joint attachment portion (wall portion on the traveling device 3 side) 87 to which the swivel joint 76 is attached. The joint attachment portion 87 protrudes from the inner side of the swivel bearing 8 toward the swivel joint 76 (see FIG. 14). In detail, the joint attachment portion 87 extends horizontally from the inner circumference edge 85*a* of the inner ring attachment portion 85 to the swivel axis X1. The joint attachment portion 87 includes a first wall portion 87A and a second wall portion 87B. The first wall portion 87A extends rearwardly from a front portion of the inner periphery edge 85A of the inner ring attachment portion 85. The second wall portion 87B extends forward from a rear portion of the inner periphery edge 85*a* of the inner ring attachment portion 85. The inner periphery of the inner ring attachment portion 85 is open. In detail, the top plate 79 has an opening 88 including an inner circumferential edge 85*a* of the inner ring attachment portion 85, an outer extension of the first wall portion 87A (an edge forming an outline) and an outer extension of the second wall portion 87B.

As shown in FIG. 16 and FIG. 17, the first attachment wall 83A is placed on the extended end side 87A (on the side of the swivel axis X1) of the first wall portion 87A. The second attachment wall 83B is placed on the extended end side 87A of the second wall portion 87B. The first attachment wall 83A is attached to the first wall portion 87A from below by a bolt. The second attachment wall 83B is attached to the second wall portion 87B from below by a bolt.

Figure 18:
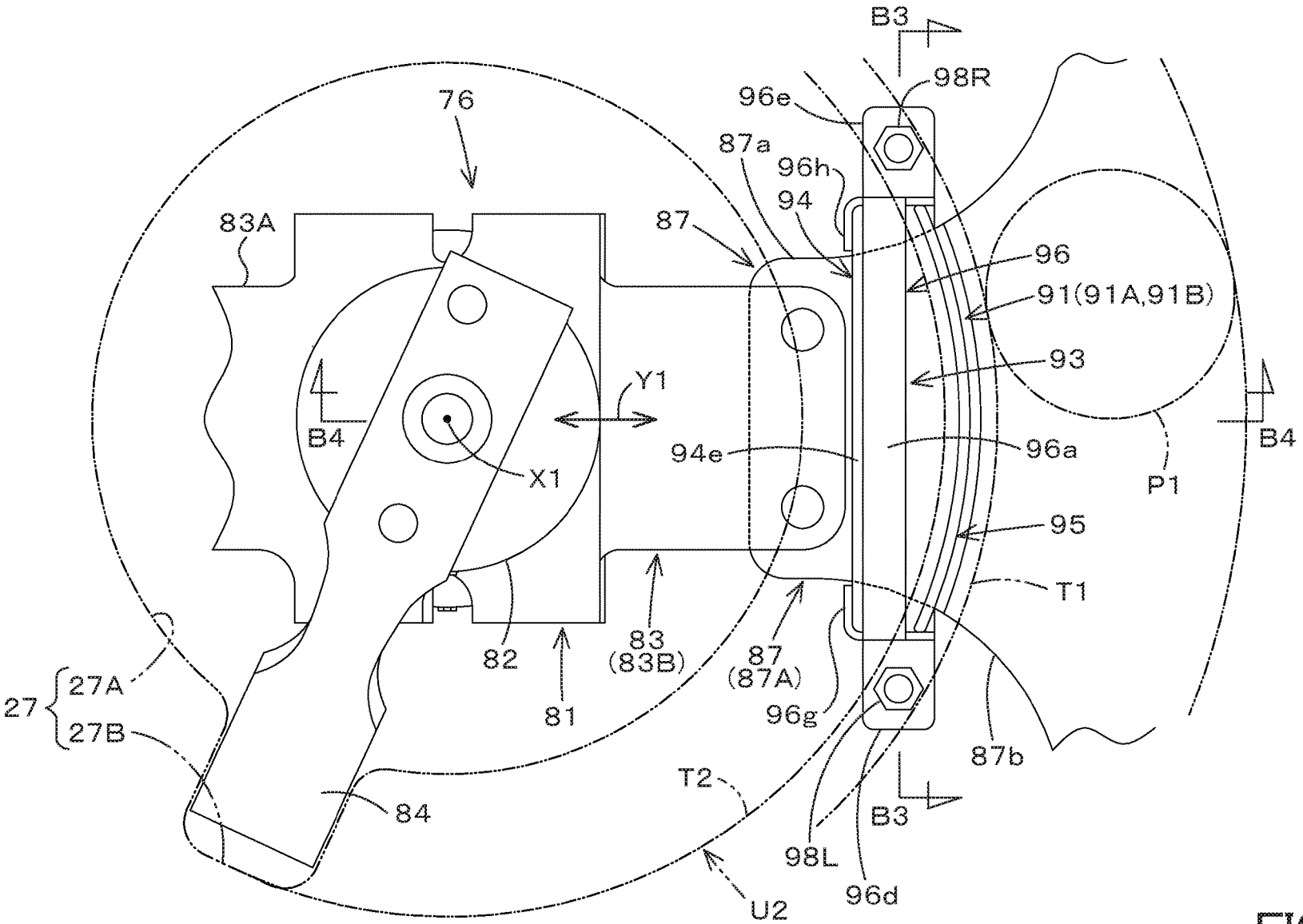
FIG. 18 is a plan view of an arrangement portion of a protection cover.

As shown in FIG. 18, the base portion 87*b* of the second wall portion 87B is progressively wider in the horizontal direction (the width of the machine width direction K2) from the tip of the joint attachment portion 87 (the end of the swivel joint 76 side) to the base portion (the end of the inner ring attachment portion 8 side). The left and right edges of the base portion 87B are formed in a curved shape that is concave toward the inside of the machine body. The base portion 87*b* of the first wall portion 87A is also formed progressively wider from the tip to the base, and the left and right outer extensions of the base portion 87*b* are formed in a curved shape that is concave toward the inside of the machine body.

In the working machine 1 of the present embodiment, a foreign object such as soil, pebbles, dust, and the like may fall between the swivel joint 76 and the swivel frame 21, specifically, between the first opening 27 of the swivel base 22 and the swivel joint 76 or the engagement member 84. For example, when the foreign matter travels (rolls) over the joint attachment portion 87 to the inner tooth gear 75, the foreign matter may become trapped between the inner tooth gear 75 and the swivel pinion P1. Therefore, as shown in FIG. 15, FIG. 16, and FIG. 17, the present embodiment has at least one protection cover 91 that prevents the foreign object falling from between the swivel joint 76 and the swivel frame 21 from moving to the inner tooth gear 75.

In this embodiment, the protection cover 91 is provided with a plurality of protection covers 91 (a first protection cover 91A, a second protection cover 91B). The first protection cover 91A is attached to the first wall portion 87A, and the second protection cover 91B is attached to the second wall portion 87B. The first protection cover 91A and the second protection cover 91B have a similar configuration and will be described collectively.

As shown in FIG. 18 to FIG. 22, the protection cover 91 has a cover body 92 and an attachment tool 93 that attaches the cover body 92 to the joint attachment portion 87. The cover body 92 is formed by an elastic member such as rubber. The attachment tool 93 is made of metal (sheet metal) in the present embodiment.

Figure 20:
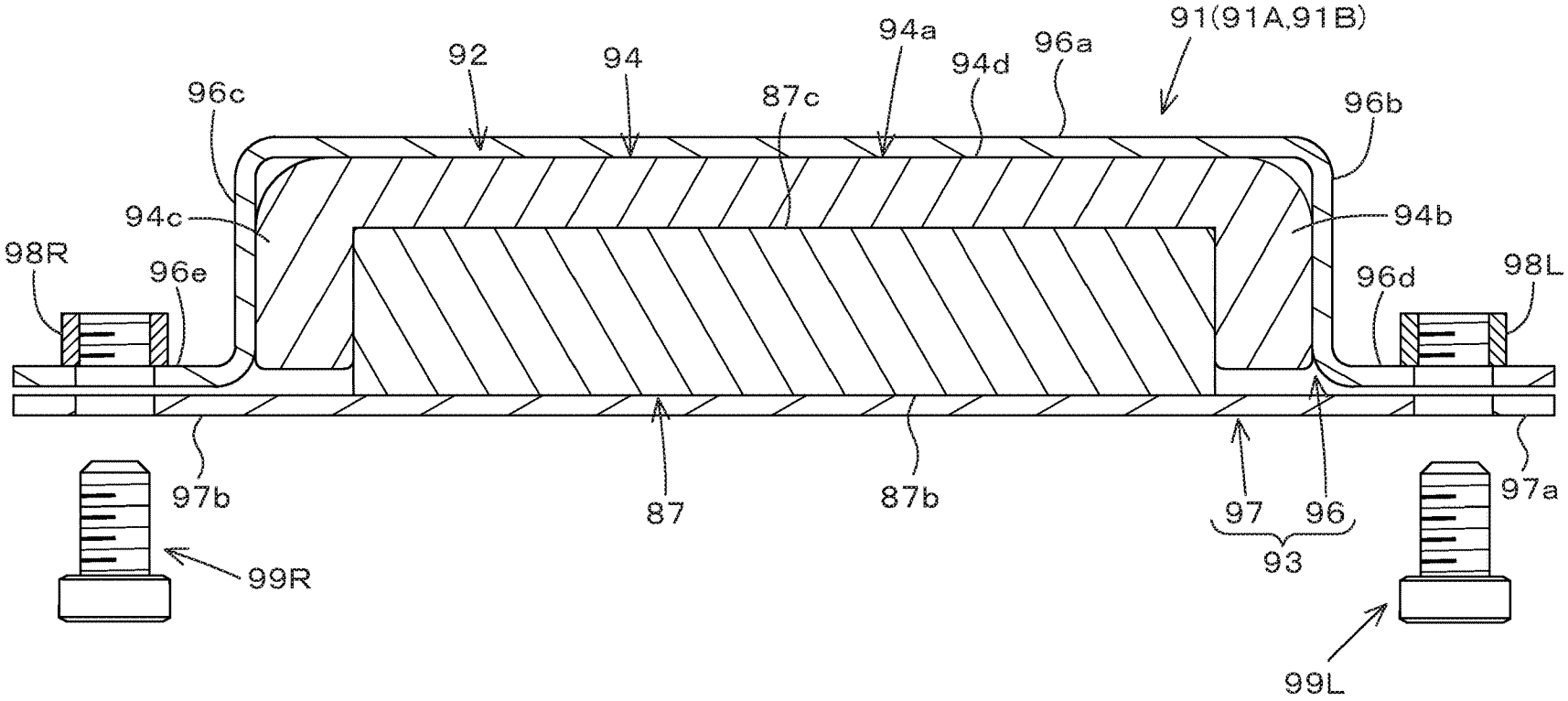
FIG. 20 is a cross section view in B3-B3 arrowed line of FIG. 18.
Figure 21:
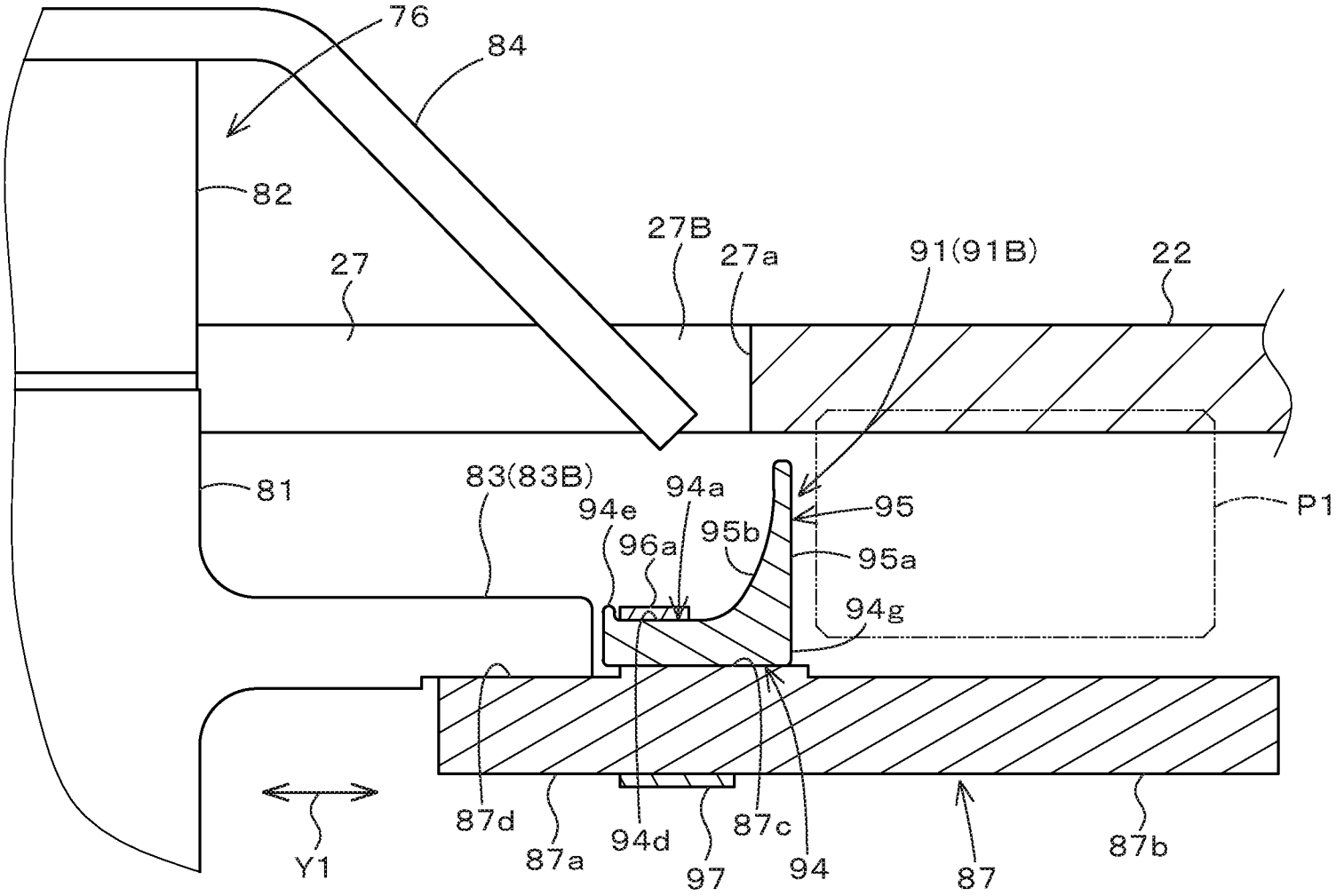
FIG. 21 is a cross section view in B4-B4 arrowed line of FIG. 18.
Figure 22:
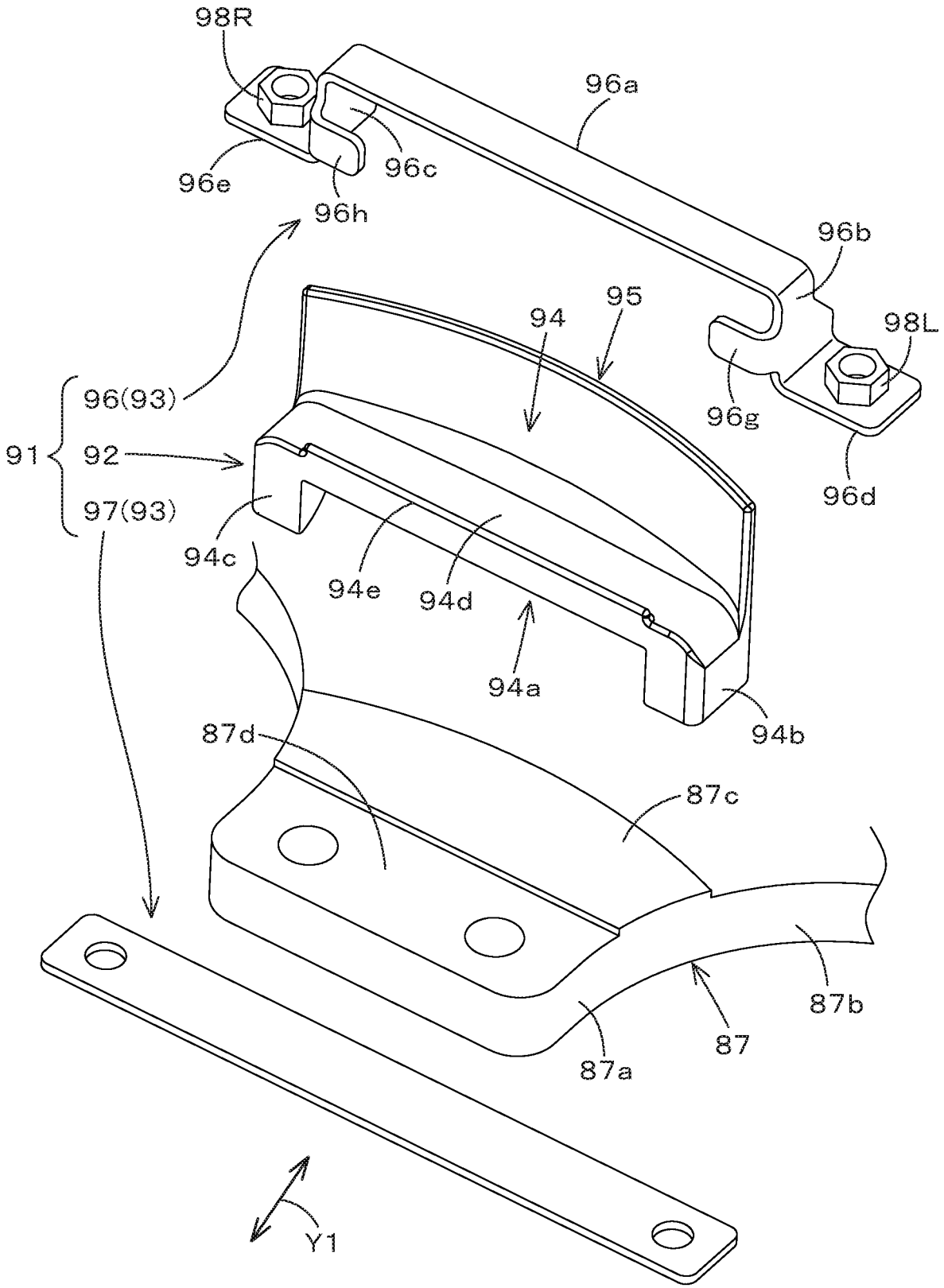
FIG. 22 is a perspective view illustrating development of a protection cover.

As shown in FIG. 21 and FIG. 22, the cover body 92 has an attachment base 94 to be attached to the joint attachment portion 87 and a guard wall 95 extending upwardly from the attachment base 94. The attachment base 94 has a mounting portion 94*a*, a first extending portion 94*b* extending downwardly from one side of the machine width direction K2 of the mounting portion 94*a*, and a second extending portion 94*c* extending downwardly from the other side of the machine width direction K2 of the mounting portion 94*a* (see FIG. 20). The placing portion 94*a* is placed on the attachment surface 87*c* of the joint attachment portion 87. The attachment surface 87*c* is located on the tip side of the base portion 87*b* (opposite to the connection end side connecting to the inner ring attachment portion 85) and is adjacent to the attachment surface 87*d* to which the attachment wall 83 is attached. That is, the mounting portion 94*a* is horizontally adjacent to the attachment wall 83. In other words, the mounting portion 94*a* is adjacent to the attachment wall 83 in the swivel radial direction Y1. The swivel radial direction Y1 refers to the radial direction of the swivel circle, which is a circle centered at the swivel axis X1 (see FIG. 18).

As shown in FIG. 16 and FIG. 18, the attachment base 94 (attachment surface 87*c*) is located outside Y1 in the swivel diameter direction than the inner edge of the main hole 27A of the first opening 27. As shown in FIG. 20, the base portion 87*b* is located between the first extending portion 94*b* and the second extending portion 94*c*. That is, the joint attachment portion 87 is sandwiched between the first extending portion 94*b* and the second extending portion 94*c*.

As shown in FIG. 20, the upper surface of the placing portion 94*a* is a flat mounting surface 94*d*. As shown in FIG. 21, a regulator protruding portion 94*e* is formed in the machine width direction K2 at an end on the inner side of the swivel diameter direction Y1 (on the side of the attachment wall 83) of the mounting surface 94*d*.

As shown in FIG. 22, a guard wall 95 is provided on the attachment base 94 over the machine width direction K2. The guard wall 95 protrudes upwardly from an edge on the outer side of the upper surface of the attachment base 94 in the swivel diameter direction Y1 (opposite to the regulator protruding portion 94*e*). As shown in FIG. 18, the guard wall 95 is disposed on the inner side of the movement track U1 of the swivel pinion P1 (on the inner side of the inner edge T1 of the movement track U1) and is formed in a curved shape centered on the swivel axis center X1. As shown in FIG. 21, the outer surface 95*a* of the guard wall 95 in the swivel radial direction Y1 is formed continuously with the outer surface 94*g* of the attachment base 94 in the swivel radial direction Y1. Thus, the outer surface 94*g* of the attachment base 94 is also curved around the swivel axis X1.

As shown in FIG. 21, the outer surface 95*a* of the guard wall 95 and the outer surface 94*g* of the attachment base 94 are formed along the vertical direction. The lower portion of the guard wall 95 is formed such that the thickness (the dimension of Y1 in the swivel diameter direction) progressively increases as one extends downward. The inner side of the lower portion of the lower portion of the guard wall 95 in the swivel diameter direction Y1 (referred to as the lower inner surface 95*b*) is formed in a curved shape in side view. The lower inner surface 95*b* of the guard wall 95 is located below the outer end 27*a* of the swivel diameter direction Y1 of the notch hole 27B, with the notch hole 27B being located above the joint attachment portion 87. Therefore, foreign matter falling from the gap between the notched hole 27B and the engagement member 84 is guided by the lower inner surface 95B to the inner side of the swivel diameter direction Y1.

As shown in FIG. 18, the guard wall 95 is located between the inner periphery edge T1 of the movement trajectory U1 of the swivel pinion P1 and the outer periphery edge T2 of the movement trajectory U2 of the notched hole 27*b*. This allows the guard wall 95 to effectively prevent foreign matter from moving into the inner tooth gear 75 without interfering with the swivel pinion P1. The guard wall 95 may have an upper portion located between the inner periphery edge T1 and the outer periphery edge T2, as in the present embodiment, or the entire guard wall 95 may be located between the inner periphery edge T1 and the outer periphery edge T2.

As shown in FIG. 20 and FIG. 22, the attachment tool 93 has a first member 96 that sandwiches the attachment base 94 (cover body 92) in conjunction with the joint attachment portion 87, and a second member 97 that sandwiches the joint attachment portion 87 in conjunction with the attachment base 94 (cover body 92). The first member 96 is disposed in a position corresponding to the cover body 92. The first member 96 has a holding portion 96*a*. The holding portion 96*a* is formed in the form of a long strip along the mounting surface 94*d*, and is placed on the mounting surface 94*d* and is contacted by surface contact. The holding portion 96*a* jointly with the joint attachment portion 87 sandwiches the placing portion 94*a* (attachment base 94). The holding portion 96*a* is regulated inwardly in the swivel diameter direction Y1 by the regulator protruding portion 94*e* (see FIG. 21).

As shown in FIG. 20, the first member 96 has a first extension piece 96*b* extending downwardly from one end of the holding portion 96*a* and a second extension piece 96*c* extending downwardly from the other end of the holding portion 96*a*. The first extension piece 96*b* sandwiches the first extending portion 94*b* in conjunction with the joint attachment portion 87. The second extension piece 96*c* sandwiches the second extending portion 94*c* in conjunction with the joint attachment portion 87. The first member 96 has a first attachment piece 96*d* extending outwardly from the lower end of the first extending portion 94*b* and a second attachment piece 96*e* extending outwardly from the lower end of the second extending portion 94*c*. A nut 98L is fixed to the upper surface of the first attachment piece 96*d*. A nut 98R is also fixed to the upper surface of the second attachment piece 96*e*.

Figure 19:
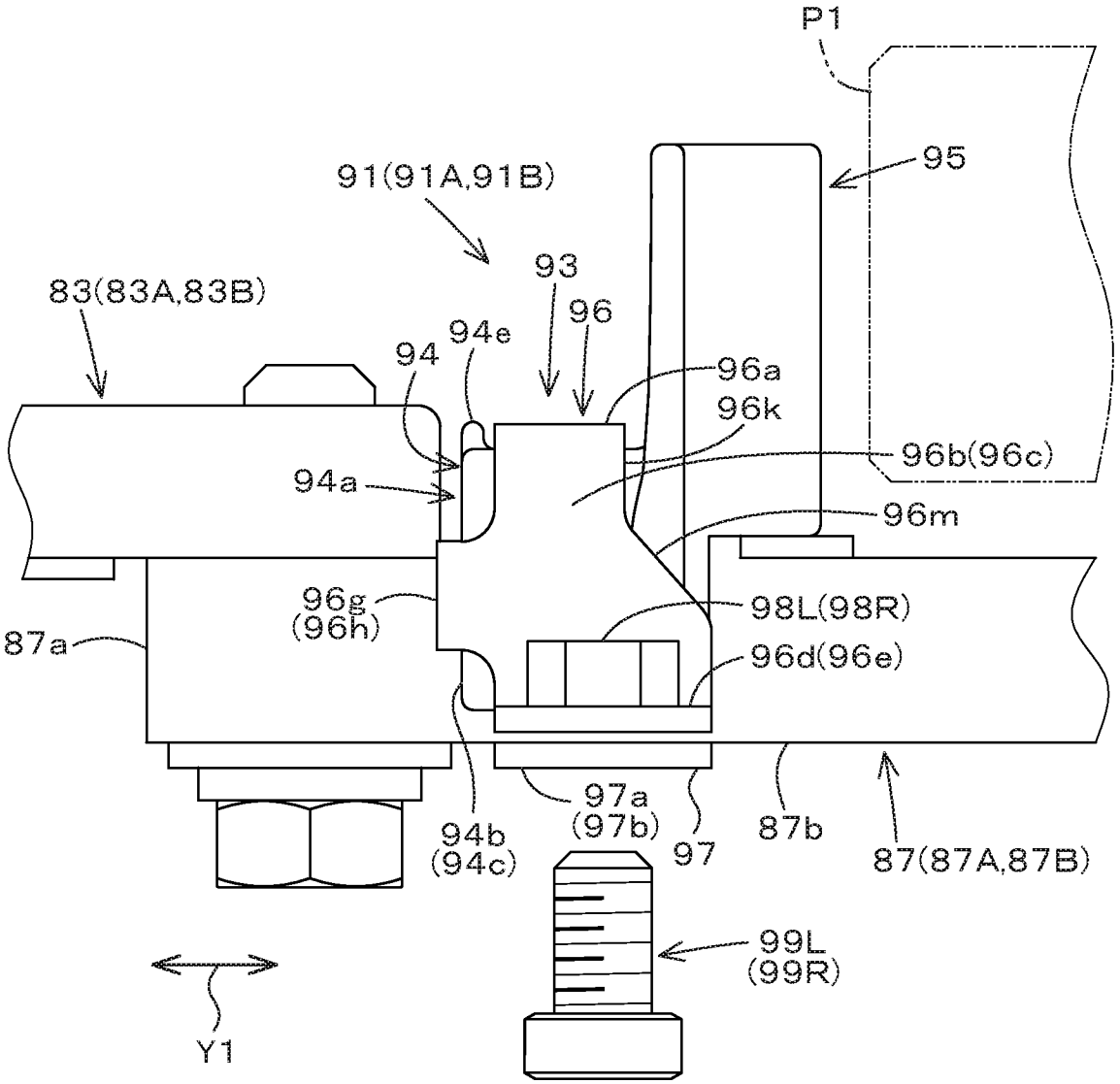
FIG. 19 is a side view of an arrangement portion of a protection cover.

As shown in FIG. 19, the outward end of the first extending portion 94*b* in the swivel radial direction Y1 is formed in an inclined shape with the upper portion 96*k* formed along the vertical direction and the lower portion 96*m* sloping away from the swivel joint 76 as it extends downward. The lower portion 96*m* is located below the swivel pinion P1. The outer end of the second extending portion 94*c* in the swivel diameter direction Y1 is similarly formed.

As shown in FIG. 22, the attachment portion 93 has a movement control portion (first control portion 96*g*, second control portion 96*h*) that regulates movement of the attachment portion 93 toward the inner tooth gear 75 by engaging the joint attachment portion 87. The first control portion 96*g* extends from an inner end of the first extension piece 96*b* in the swivel diameter direction Y1 toward the inner side of the machine body. The first regulator portion 96*g* is in contact with the first extension piece 94*b*. The second regulator portion 96*h* extends from an inner end of the second extension piece 96*c* in the swivel diameter direction Y1 toward the inside of the machine body. The second control portion 96*h* is in contact with the second extension piece 94*c*. A joint attachment portion 87 is located between the first control portion 96*g* and the second control portion 96*h*. That is, the second regulator portion 96*h* jointly with the first regulator portion 96*g* sandwiches the base portion 87*b* of the joint attachment portion 87 in the machine width direction.

As shown in FIG. 22, the second member 97 is formed in the form of a long strip and flat plate in the machine width direction K2. As shown in FIG. 20, the second member 97 is in contact with the lower surface of the joint attachment portion 87, and jointly with the mounting portion 94*a* (attachment base 94), it sandwiches the joint attachment portion 87. The second member 97 protrudes from the joint attachment portion 87 on both sides of the longitudinal direction. One end portion 97*a* of the second member 97 is located below the first attachment piece 96*d*. The other end portion 97*b* of the second member 97 is located below the second attachment piece 96*e*. One end portion 97*a* of the second member 97 and the first attachment piece 96*d* are fastened to the first attachment piece 96*d* by a bolt 99L. The bolt 99L is screwed (threaded) into the nut 98L from below through the one end portion 97*a* and the first attachment piece 96*d*. The other end 97*b* and the second attachment piece 96*e* of the second member 97 are fastened to the second attachment piece 96*e* by the bolt 99R. The bolt 99R is screwed to the nut 98R from below through the other end 97*b* and the second attachment piece 96*e*.

Before the first member 96 and the second member 97 are fastened to the first member 96 and the second member 97 by bolts 99L and 99R, as shown in FIG. 20, a clearance (crush allowance of the rubber forming the attachment base 94) is provided between the first end 97*a* and the first attachment piece 96*d* and between the other end 97*b* and the second attachment piece 96*e*. A clearance is also provided between the first and second extending portions 94*b* and 94*c* and the joint attachment portion 87. When the first member 96 and the second member 97 are fastened to the first member 96 and the second member 97 by bolts 99L and 99R in this state, the mounting portion 94*a* is pressed against the joint attachment portion 87 by the holding portion 96*a*. Thereby, the protection cover 91 is attached to the joint attachment portion 87. The elastic deformation of the first extending portion 94*b* is regulated by the first extension piece 96*b* and the first regulator portion 96*g*, and the elastic deformation of the second extending portion 94*c* is regulated by the second extension piece 96*c* and the second regulator portion 96*h*. This allows the protection cover 91 to be securely attached to the joint attachment portion 87.

Figure 23:
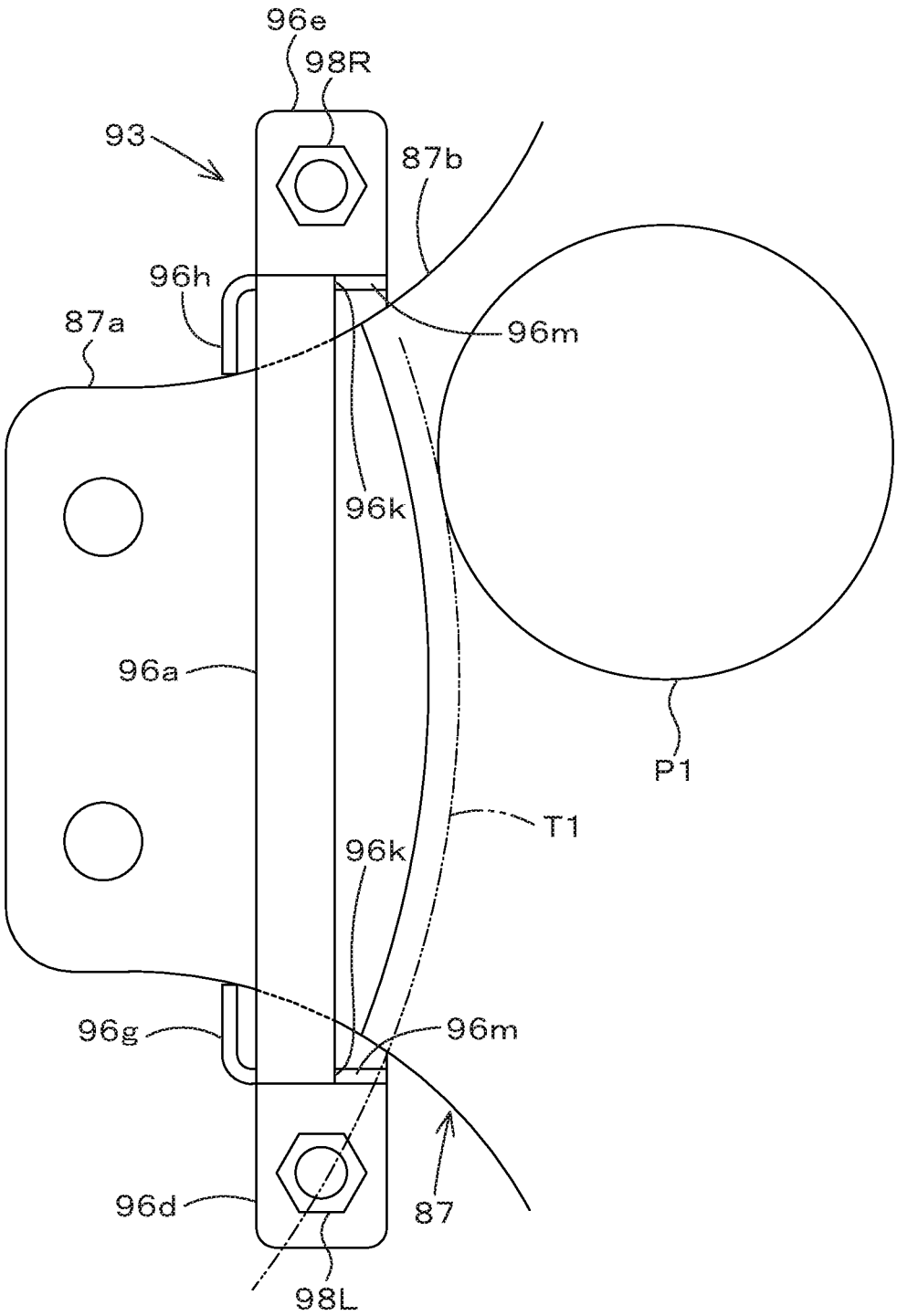
FIG. 23 is a plan view illustrating a relation between an attachment tool and a joint attachment portion.

In the protection cover 91 of the above-described embodiment, for example, when the cover body 92 is damaged or otherwise detached, as shown in FIG. 23, the first control portion 96*g* and the second control portion 96*h* regulate the movement of the attachment tool 93 toward the inner tooth gear 75 by engaging (coming into contact with) the joint attachment portion 87. This prevents interference between the attachment portion 93 and the swivel pinion P1.

Figure 24:
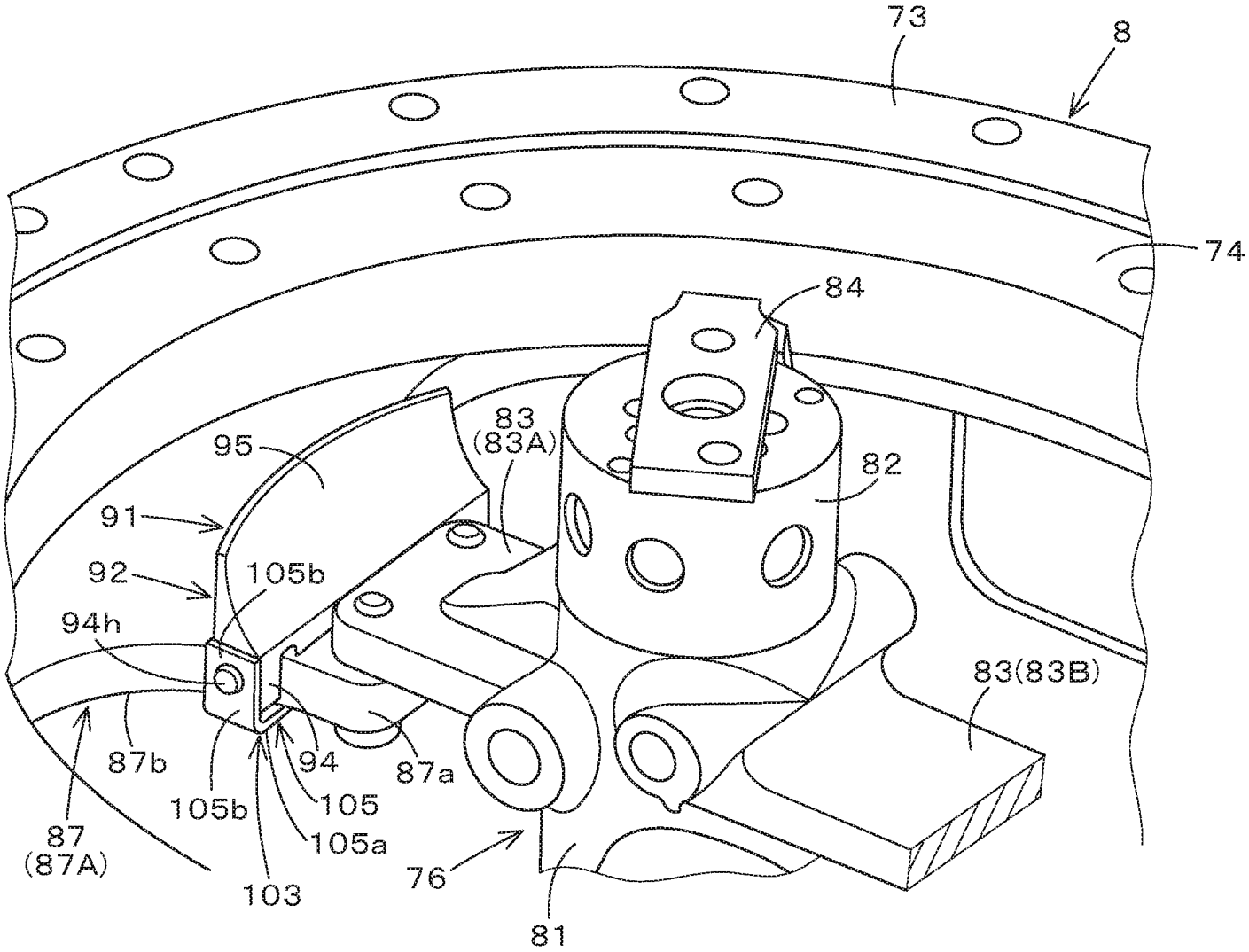
FIG. 24 is a perspective view of a protection cover seen from the left side according to a modified example 1.
Figure 25:
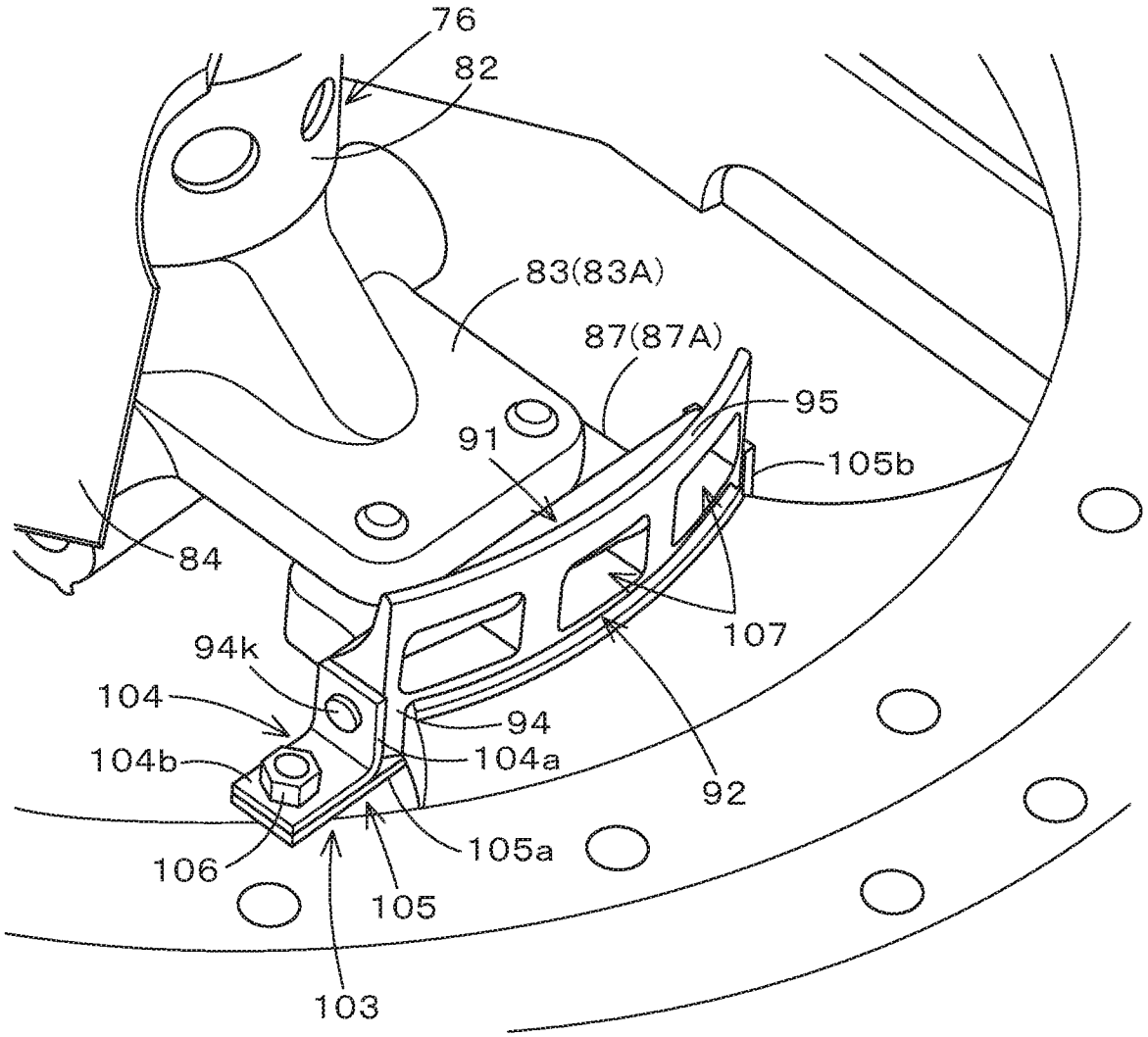
FIG. 25 is a perspective view of a protection cover seen from the right side according to a modified example 1.

FIG. 24 and FIG. 25 show a modified example 1 of the protection cover 91. These FIG. 24 and FIG. 25 show a protection cover 91 on the forward side of the swivel joint 76. FIG. 24 shows a view of the protection cover 91 from the left side. FIG. 25 is a view of the protection cover 91 from the right side (opposite side).

As shown in FIG. 24 and FIG. 25, the protection cover 91 has a cover body 92 and an attachment tool 103. The cover body 92 has an attachment base 94 and a guard wall 95. The attachment base 94 has a cylindrical projection 94*h* on one side and a similar projection 94*k* on the other side. The attachment tool 103 has a first member 104 and a second member 105.

The first member 104 is formed in an L-shape having a first piece 104*a* in contact with the other side of the attachment base 94 and a second piece 104*b* extending from the first piece 104*a*, wherein the projection 94*k* is inserted, and a second piece 104*b* extending from the first piece 104*a*. A nut 106 is fixed on the second piece 104*b*.

The second member 105 is formed in the shape of an L-shape having a lower wall 105*a* that contacts the lower surface of the joint attachment portion 87 and a vertical wall 105*b* that rises from one end of the lower wall 105*a* and contacts one side of the attachment base 94 and into which the projection 94*h* is inserted. The other end of the lower wall 105*a* protrudes from the joint attachment portion 87 and is located below the second piece 104*b*. The first member 104 and the second member 105 are fastened to the first member 104 and the second member 105 by a bolt that is screwed to the nut 106 by inserting the other end of the lower wall 105*a* and the second piece 104*b* from below. This allows the protection cover 91 to be attached to the joint attachment portion 87.

The protection cover 91 of the modified example 1 does not have the regulator protruding portion 94*e* of the above embodiment. A plurality of recess portions 107 are provided on the outer side of the swivel radial direction Y1 to prevent or inhibit the generation of so-called "sink mark". The other configurations are configured in much the same way as in the above embodiment.

Figure 26:
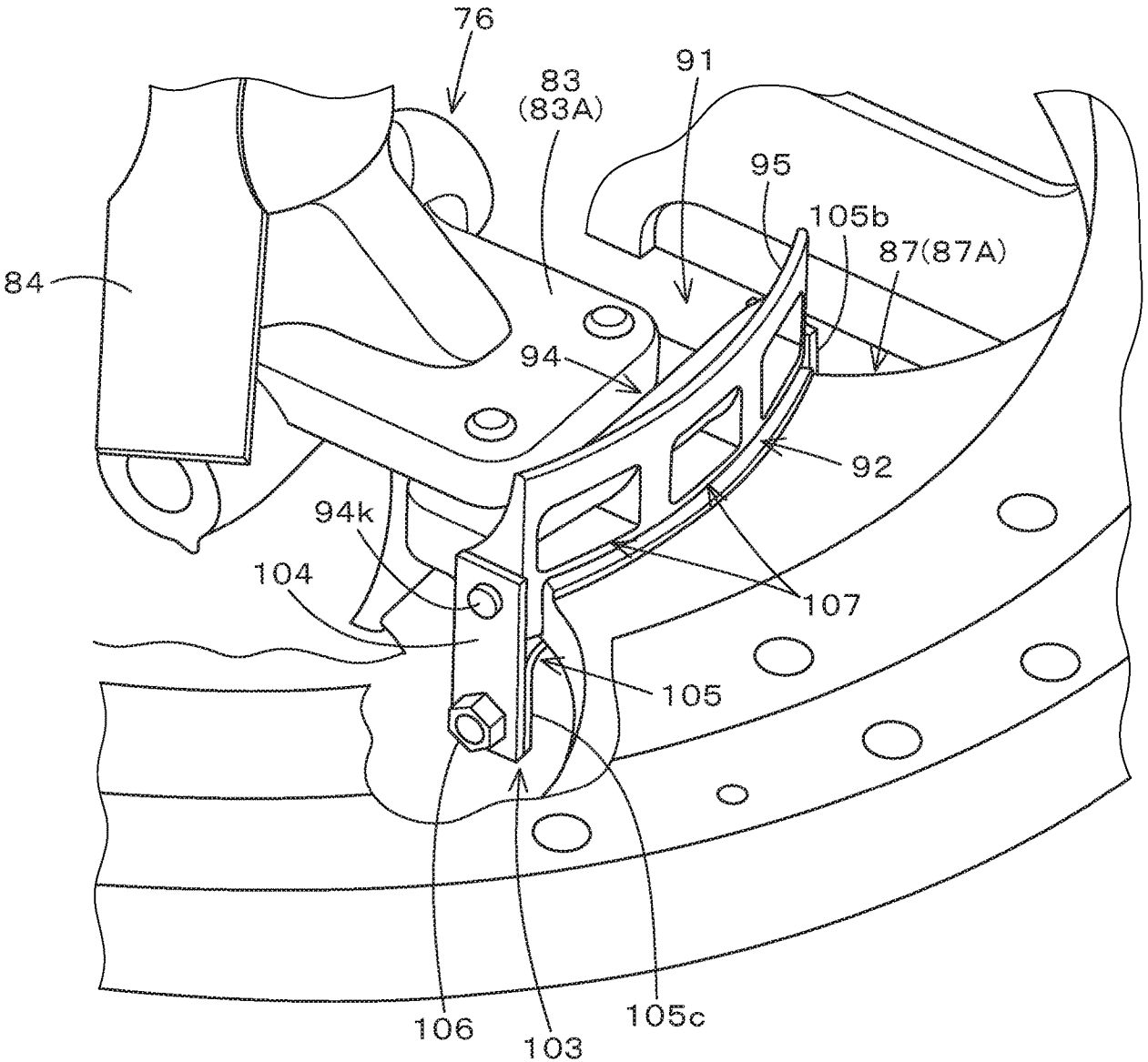
FIG. 26 is a perspective view of a protection cover according to a modified example 2.

FIG. 26 shows a modified example 2 of the protection cover 91. For this modified example 2, the differences from modified example 1 will be described. In the attachment tool 103 of the protection cover 91 of this modified example 2, the first member 104 is formed in the form of a flat plate long in the vertical direction, the upper portion of which touches the other side of the attachment base 94 and into which the projection 94*k* is inserted. A nut 106 is fixed at the bottom. The second member 105 has an extended wall 105*c* extending downwardly from the other end of the lower wall 105*a* and facing the lower portion of the first member 104. Bolts fastening the first member 104 to the second member 105 are screwed to the nut 106 by inserting the extended wall 105*c* and the lower portion of the first member 104.

Other configurations are configured in the same manner as in the modified example 1.

FIG. 27 to FIG. 30 show a modified example 3 of the protection cover 91. The protection cover 91 of this modified example 3 is made of sheet metal.

Figure 27:
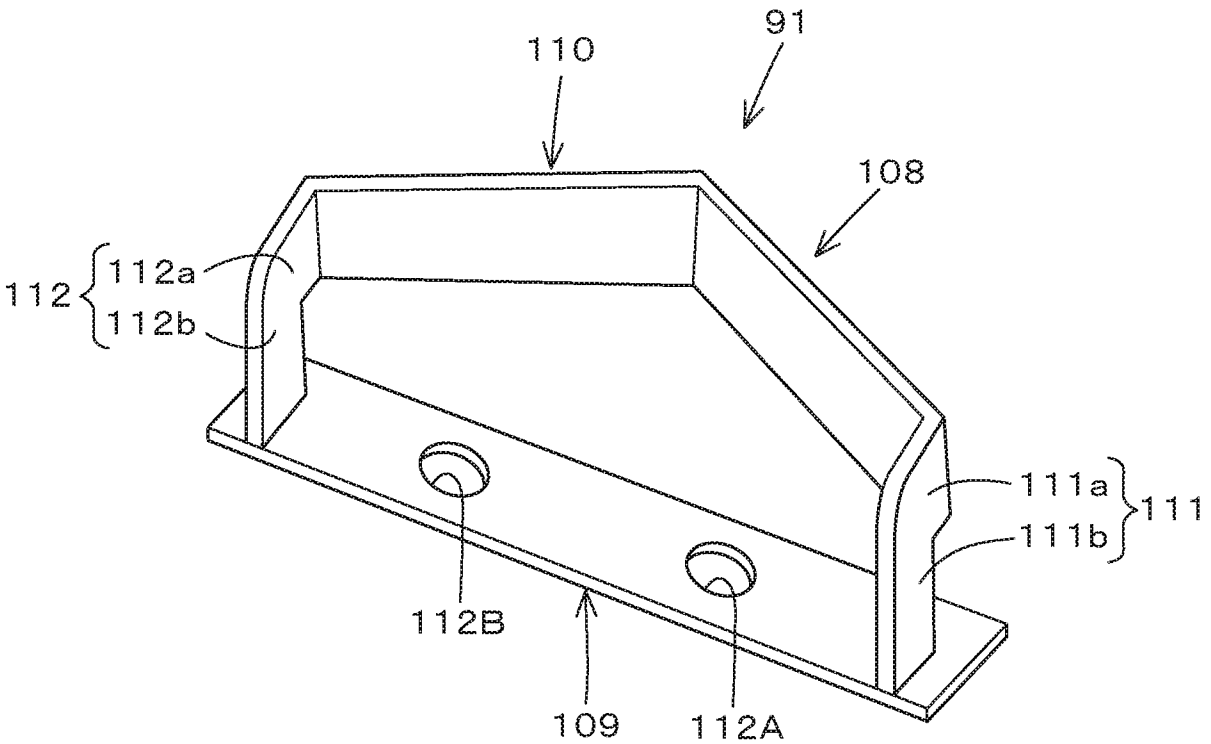
FIG. 27 is a perspective view of a protection cover according to a modified example 3.

As shown in FIG. 27, the protection cover 91 of this modified example 3 has a cover body 108 and a attachment piece 109. The cover body 108 has a guard wall 110 and a plurality of support legs (first support legs 111, second support legs 112).

Figure 28:
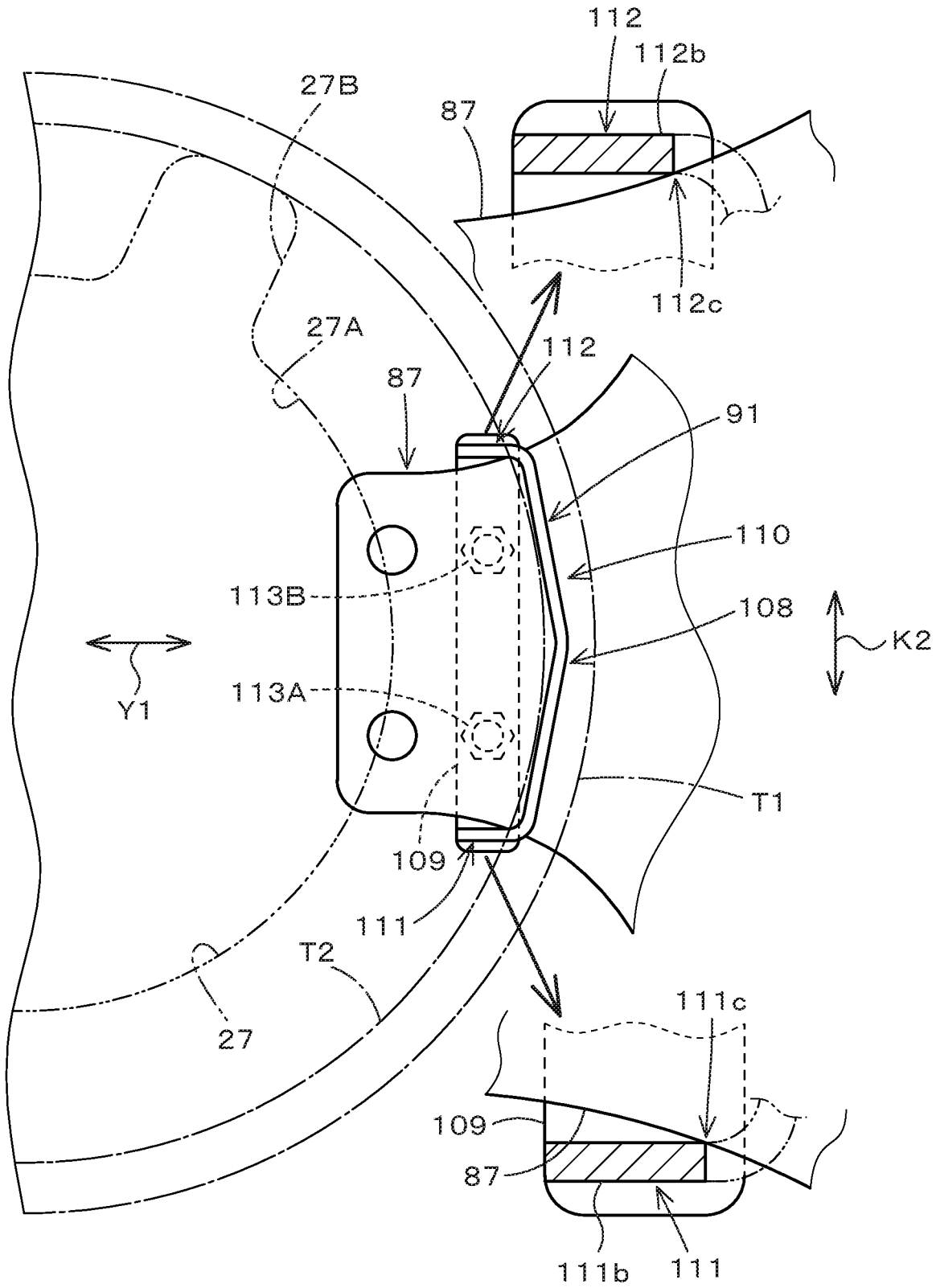
FIG. 28 is a plan view and a cross section view illustrating a plan view of a part of a protection cover according to a modified example 3.

As shown in FIG. 28, the guard wall 110 is bent at the center of the machine width direction K2 and is formed in a convex planar V-shape toward the outside of the swiveling radial direction Y1. The guard wall 110 is thereby formed to fit between the inner periphery edge T1 and the outer periphery edge T2. The guard wall 110 may be formed in a curved shape along the inner periphery edge T1 and the outer periphery edge T2.

As shown in FIG. 27, the first support leg 111 has a connector portion 111*a* connected to one end of the guard wall 110 and a leg portion 111*b* extending downwardly from the connector portion 111*a*. The second support leg 112 has a connector portion 112*a* connected to the other end of the guard wall 110 and a leg portion 112*b* extending downwardly from the connector portion 112*a*. As shown in FIG. 28, the leg portions 111*b* and the leg portions 112*b* are disposed so that the joint attachment portion 87 is sandwiched between the joint attachment portions 87 from both sides of the machine width direction K2.

As shown in FIG. 27, the attachment piece 109 is formed of a flat plate in the form of a long strip in the machine width direction K2, with a plurality of bolt insertion holes 112A and 112B formed in a penetrating manner. The attachment piece 109 is fixed at one end to the lower end of the first support leg 111 and the other end to the lower end of the second support leg 112.

A threaded hole 113A and a threaded hole 113B are formed in the joint attachment portion 87 from the lower surface side upwardly.

Figure 29:
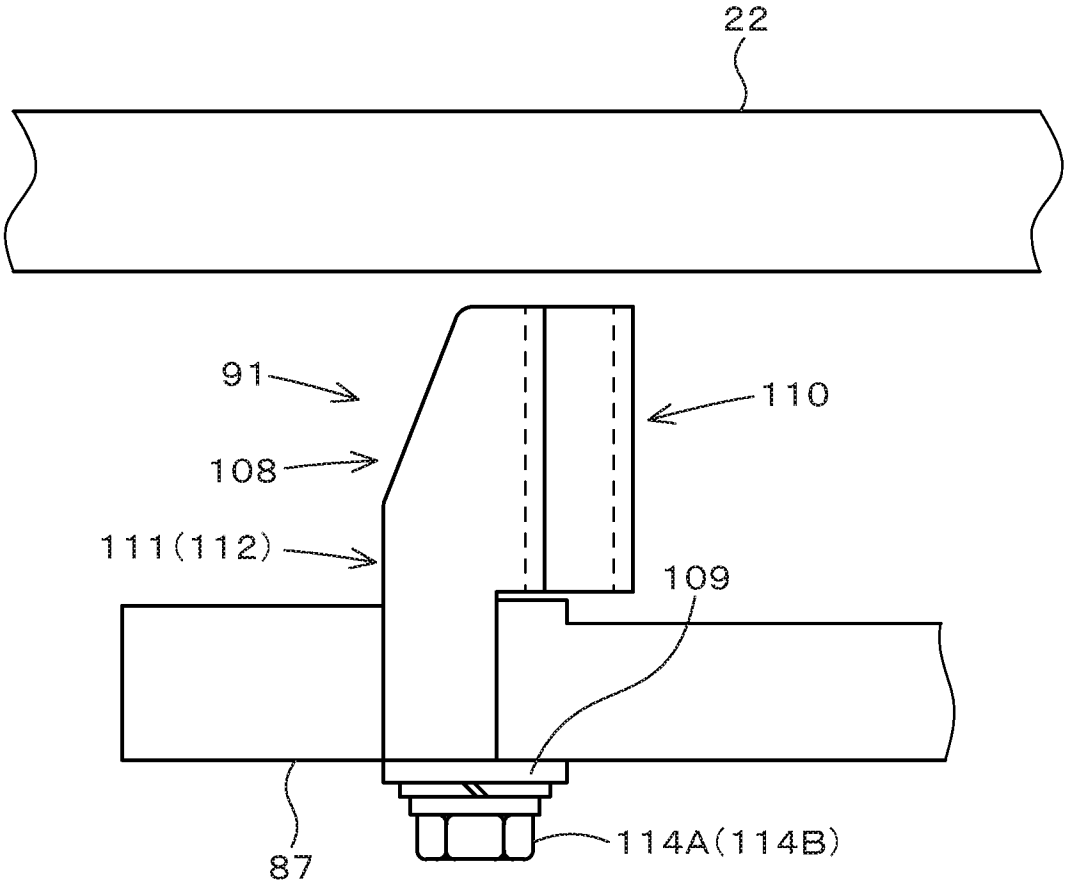
FIG. 29 is a side view of a protection cover according to a modified example 3.
Figure 30:
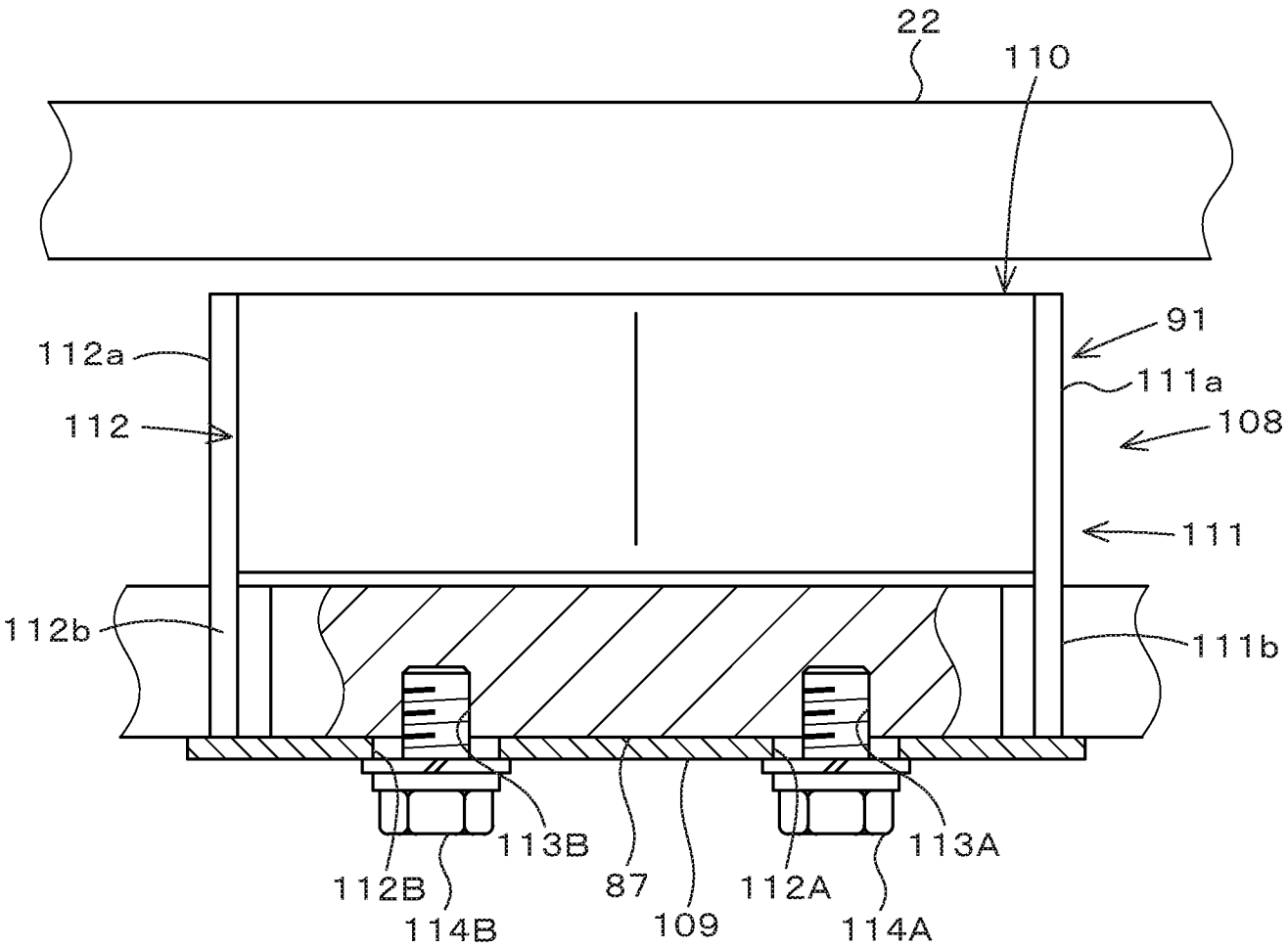
FIG. 30 is a cross section view illustrating a front view of a part of a protection cover according to a modified example 3.

The protection cover 91 of the modified example 3 is fitted to the joint attachment portion 87 from the end portion of the joint attachment portion 87 (the inner end of the swivel diameter direction Y1) from the tip portion of the joint attachment portion 87 (the inner end of the swivel diameter direction Y1) so that the joint attachment portion 87 is inserted between the guard wall 110 and the attachment piece 109, as shown in FIG. 29 and FIG. 30. As shown in FIG. 28, the movement of the protection cover 91 toward the inner tooth gear 75 is regulated by having the corner portion 111*c* of the leg portion 111*b* and the corner portion 112*c* of the leg portion 112*b* come into contact with the joint attachment portion 87. This positions the protection cover 91 so that the guard wall 110 fits between the inner periphery edge T1 and the outer periphery edge T2. In this state, as shown in FIG. 30, the bolt insertion hole 112A coincides with the threaded hole 113A and the bolt insertion hole 112B coincides with the threaded hole 113B, as shown in FIG. 30. The protection cover 91 is attached to the joint attachment portion 87 by inserting the bolt 114A into the bolt insertion hole 112A and screwing the bolt 114B into the bolt insertion hole 112B and screwing the bolt 114B into the threaded hole 113B.

The above corner portions 111*c* and 112*c* are positional regulator portionss that regulate the movement of the protection cover 91 toward the inner tooth gear 75 by engaging the joint attachment portion 87.

Other configurations are configured in the same manner as in the above embodiment.

Figure 31:
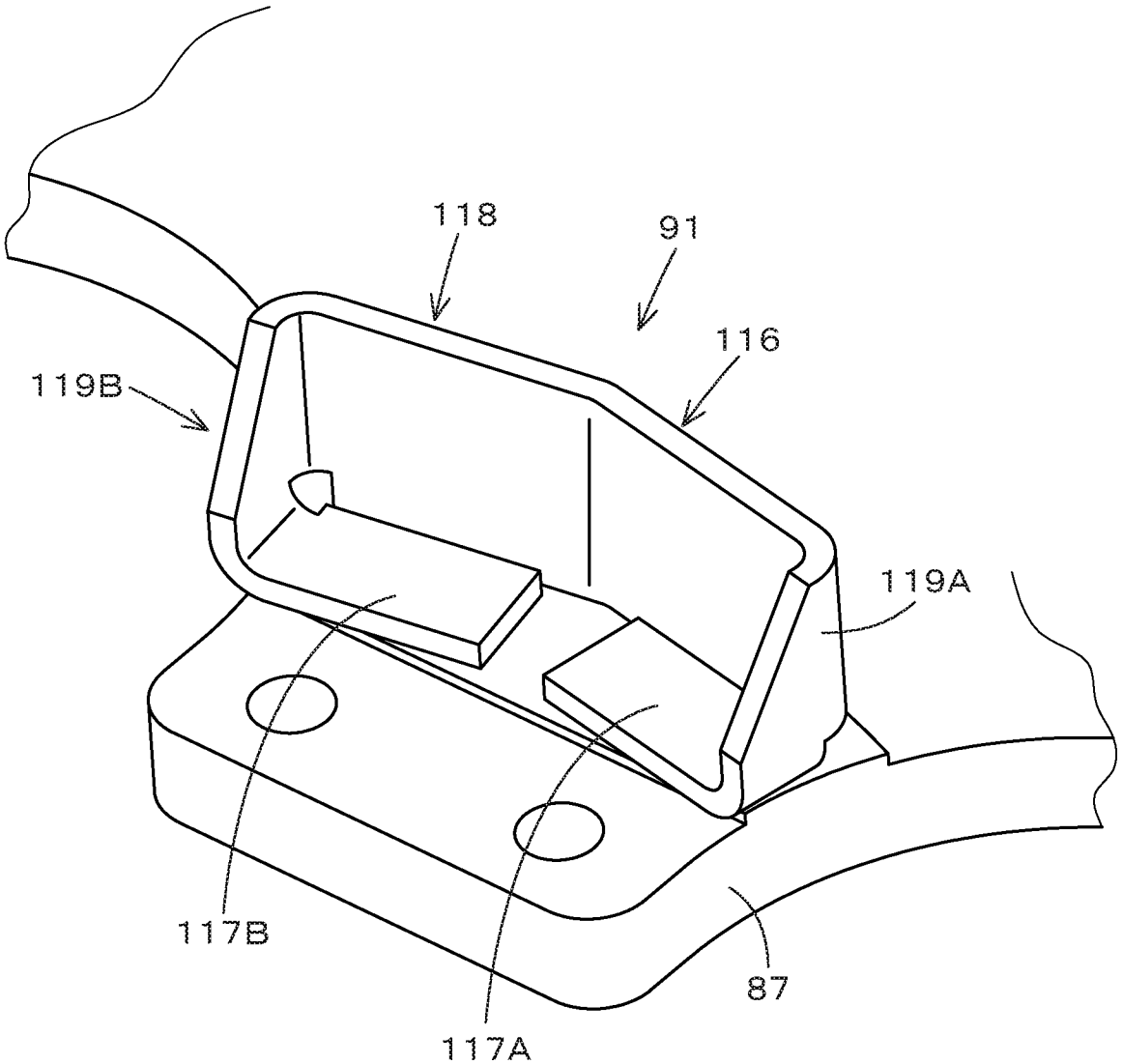
FIG. 31 is a perspective view of a protection cover according to a modified example 4.

FIG. 31 shows a modified example 4 of the protection cover 91. The protection cover 91 of this modified example 4 is also made of sheet metal, as in the modified example 3.

The protection cover 91 of modified example 4 has a cover body 116 and a plurality of attachment pieces (first attachment piece 117A, second attachment piece 117B). The cover body 116 has a guard wall 118 and a plurality of support legs (first support leg 119A, second support leg 119B).

The first attachment piece 117A extends inwardly into the machine body from a lower end of the first support leg 119A. The second attachment piece 117B is extended inwardly into the machine body from a lower end of the second support leg 119B. The first and second attachment pieces 117A and 117B are placed on the upper surface of the joint attachment portion 87 and secured by welding. Other configurations are configured in the same manner as in the above embodiment.

In the present embodiment, the following effects are achieved.

The working machine 1 includes the support member (the support bracket 24), the turn member (the swing bracket 14), the pin (the first pin 39A) inserted to both of the support member and the turn member to turnably support the turn member on the support member, the flange 46 fixed to the pin, the collar 52 inserted to an insertion hole formed in the flange, the retainer bolt 55 inserted to the collar 52 and attached by being screwed to the turn member, the contact portion 51 included in the flange 46, and the regulator 58 included in the support member. The regulator 58 contacts to the contact portion 51 with the clearances S4 and S5 kept between the collar 52 and the inner circumference surface of the insertion hole 50B, thereby regulating turning of the flange 46, which is turnable together with the pin, around the axis of the pin.

According to this configuration, torque down of the retainer bolt 55 can be prevented by preventing an external force from acting on the retainer bolt 55.

The flange 46 includes the base portion 49 secured to the pin and the protruding portion 50 protruding radially outwardly from the base portion 49 and having the insertion hole 50B, and the contact portion 51 is provided in the protruding portion 50.

According to this configuration, it is easy to manage the clearance between the contact portion 51 and the regulator portion 58.

The contact portion 51 has a first contact portion 51L provided on the first rotational direction side around the pin at the flange 46 and a second contact portion 51R provided on the second rotational direction side around the pin, and the regulator portion 58 includes a first portion 58L with which the first contact portion 51L contacts and a second portion 58R with which the second contact portion 51R contacts.

According to this configuration, the movement of the flange 46 in both directions around the pin can be regulated.

With the center of the insertion hole 50B and the center of the collar 52 substantially coinciding with the center of the insertion hole 50B and the center of the collar 52, the clearance S1 between the inner surface of the inner surface of the insertion hole 50B and the outer surface of the collar 52 is larger than the clearance S2 between the first contact portion 51L and the first portion 58L, and larger than the clearance S3 between the second contact portion 51R and the second portion 58R.

According to this configuration, the torque reduction of the retainer bolt due to the flange 46 coming into contact with the collar 52 can be prevented.

The member to which the retainer bolt 55 is mounted has the processed surface 56 on which the flange 46 contacts in surface contact, and the first portion 58L and the second portion 58R are formed on a surface continuous with the processed surface 56.

According to this configuration, the regulator portion 58 can be formed at the same time when forming the processed surface 56, and the regulator portion 58 can be formed easily.

The support member has a support wall portion (first support portion 24A), the rotational member has a rotational wall portion (first wall 41A) which is superimposed on the support wall portion, the pin is inserted vertically through the rotational wall portion and the support wall portion, the flange 46 is provided at the upper end of the pin and contacts the upper surface of the rotational wall portion, the insertion hole 50B is formed through the flange 46 vertically, and the retainer bolt 55 is threaded into the threaded hole 57 formed in the rotational wall portion.

According to this configuration, the torque reduction of the retainer bolt 55 can be effectively prevented.

It may be employed in the working machine 1 provided with the traveling device 3, the swivel base 22 supported on the traveling device 3 with the support member fixed at the front and rotatable around the longitudinal axis center, and the working tool 4 pivoted vertically to the swivel member.

In addition, the working machine 1 includes the traveling device 3, the swivel bearing 8 mounted on the traveling device 3 and having an inner tooth gear 75 on the inner side, the swivel frame 21 supported on the traveling device 3 via the swivel bearing 8 so as to enable swiveling around the longitudinal axis, the swivel motor M2 mounted on the swivel frame 21, the swivel pinion P1 engaged with the inner tooth gear 75 and configured to be activated by the swivel motor M2, the swivel joint 76 disposed at the longitudinal axial center position, and the protection cover 91 disposed on the inner side of the movement trajectory U1 of the swivel pinion P1 in the travel device 3 to prevent foreign matter from moving toward the inner tooth gear 75.

According to this configuration, the protection cover 91 prevents a foreign object from being bitten between the swivel pinion P1 and the inner tooth gear 75.

A portion of the swivel joint 76 (inner shaft 82) is provided with the engagement member 84 that engages the notch hole 27B in the swivel frame and rotates integrally with the swivel frame 21, and the protection cover 91 has guard walls 95, 110 and 118 that are located between the inner periphery edge T1 of the movement trajectory U1 of the swivel pinion P1 and the outer periphery edge T2 of the movement trajectory U2 of the notch hole 27B to prevent movement of a foreign object.

According to this configuration, the guard walls 95, 110 and 118 can effectively restrain the movement of a foreign object falling from between the engagement member 84 and the notched hole 27B to the inner tooth gear 75 side by the guard walls 95, 110 and 118.

The traveling device 3 has the joint attachment portion 87 protruding from the inner circumference of the swivel bearing 8 toward the swivel joint 76 and to which the swivel joint 76 is attached, and the protection cover 91 is attached to the joint attachment portion 87.

According to this configuration, movement of a foreign object moving through the joint attachment portion 87 to the inner tooth gear 7 side 5 can be effectively restrained.

The protection cover 91 has the cover body 92 and the attachment tools 93 and 103 that attaches the cover body 92 to the joint attachment portion 87 by sandwiching the cover body 92 and the joint attachment portion 87.

According to this configuration, the protection cover 91 can be easily attached to the joint attachment portion 87 by retrofitting.

The attachment tool 93 has the joint attachment portion 87 disposed on top of each other and the first member 96 disposed on one side of the cover body 92 and the second member 97 disposed on the other side, and the cover body 92 is formed of an elastic member and is attached to the joint attachment portion 87 through pressing against the joint attachment portion 87 by fastening the first member 96 and the second member 97.

According to this configuration, the protection cover 91 can be securely attached to the joint attachment portion 87.

The attachment tool 93 has a movement control portion that regulates movement of the attachment tool 93 toward the inner tooth gear 75 by engaging the joint attachment portion 87.

According to this configuration, interference between the attachment portion 93 and the swivel pinion P1 can be prevented.

The base portion 87*b* of the joint attachment portion 87 is progressively wider from the tip of the joint attachment portion 87 toward the base, and the movement control portion includes a first control portion 96*g* and a second control portion 96*h* that sandwiches the base portion 87*b* of the joint attachment portion 87 in the width direction in conjunction with the first control portion 96*g*. The attachment tool 93 regulates movement toward the inner tooth gear 75 by having the first and second regulator portions 96*g* and 96*h* come into contact with the base portion 87*b* of the joint attachment portion 87.

According to this configuration, the movement control portion can be easily configured.

The swivel joint 76 has the attachment wall 83 protruding from the swivel joint 76 and mounted over the joint attachment portion 87, and the protection cover 91 is mounted on the joint attachment portion 87 between the protruding end of the attachment wall 83 and the inner side of the swivel bearing 8.

According to this configuration, the attachment wall 83 can be utilized as a regulatory member to regulate the movement of the protection cover 91 toward the swivel joint 76.

The protection cover 91 has attachment pieces 109, 117A and 117B that are attached to the joint attachment portion 87 by bolts or welding.

According to this configuration, the configuration of the protection cover 91 can be simplified.

The protection cover 91 has the attachment piece 109 which is attached to the joint attachment portion 87 by a bolt, and the positional regulator portions 111*c* and 112*c* which regulates movement of the protection cover 91 towards the inner tooth gear 75 by engaging the joint attachment portion 87.

According to this configuration, it is possible to prevent the protection cover 91 from interfering with the swivel pinion P1. For example, it is also possible to position the protection cover 91 in the attachment position.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a support member;

a turn member;

a pin inserted to both of the support member and the turn member to turnably support the turn member on the support member;

a flange fixed to the pin;

a collar inserted to an insertion hole formed in the flange;

a retainer bolt inserted to the collar and attached by being screwed to the turn member;

a contact portion included in the flange; and a regulator included in the support member, wherein the regulator contacts to the contact portion with a clearance kept between the collar and an inner circumference surface of the insertion hole, thereby regulating turning of the flange around an axis of the pin, the flange being turnable together with the pin, the contact portion includes:

a first contact portion provided in the flange on a side in a first turn direction around the axis of the pin; and a second contact portion provided in the flange on a side in a second turn direction around the axis of the pin, the regulator includes:

a first portion to which the first contact portion contacts; and a second portion to which the second contact portion contacts, and a clearance between an inner surface of the insertion hole and an outer circumference surface of the collar is larger than a clearance between the first contact portion and the first portion and larger than a clearance between the second contact portion and the second portion under a condition where a center of the insertion hole coincides with a center of the collar.

2. The working machine according to claim 1, wherein the flange includes:

a base portion fixed to the pin; and a protruding portion protruding from the base portion to an outward direction of a radius of the pin and having the insertion hole, and the contact portion is included in the protruding portion.

3. The working machine according to claim 1, wherein the turn member to which the retainer bolt is attached has a processed surface to which the flange contacts in surface, and the first portion and the second portion are formed to be surfaces continuing to the processed surface.

4. The working machine according to claim 1, wherein the support member includes a support wall, the turn member includes a rotational wall portion to be overlapped with the support wall, the pin is inserted vertically through the rotation wall portion and the support wall, the flange is located on an upper end portion of the pin and contacts to an upper surface of the rotational wall portion, the insertion hole is formed to extend vertically through the flange, and the retainer bolt is screwed to a screw hole formed in the rotational wall portion.

5. The working machine according to claim 1, further comprising:

a traveling device;

a swivel base plate supported on the traveling device turnably around a vertical axis, and including a front portion to which the support member is fixed; and a working device pivoted to the turn member to be swung up and down.

* * * * *